US007267421B2

(12) United States Patent
Asauchi et al.

(10) Patent No.: US 7,267,421 B2
(45) **Date of Patent: *Sep. 11, 2007**

(54) CARTRIDGE AND PRINTING APPARATUS

(75) Inventors: Noboru Asauchi, Nagano-ken (JP); Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/191,425

(22) Filed: Jul. 28, 2005

(65) Prior Publication Data

US 2005/0264597 A1 Dec. 1, 2005

Related U.S. Application Data

(63) Continuation of application No. 10/620,872, filed on Jul. 16, 2003, now Pat. No. 6,994,415.

(30) Foreign Application Priority Data

Jul. 18, 2002 (JP) ..... 2002-209468
Jul. 18, 2002 (JP) ..... 2002-209496

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/84, 86, 6, 7

See application file for complete search history.

(56) References Cited

U.S. PATENT DOCUMENTS 4,639,738 A 1/1987 Young et al.
5,673,053 A * 9/1997 Marthinsson ..... 343/728
5,822,076 A * 10/1998 Maruyama ..... 358/296
6,012,794 A 1/2000 Nakano et al.

(Continued)

FOREIGN PATENT DOCUMENTS

EP 0 668 165 A2 8/1995

(Continued)

OTHER PUBLICATIONS

European Search Report for EP 3 015 624.4, dated Nov. 20, 2002.

(Continued)

*Primary Examiner*—Stephen Meier
*Assistant Examiner*—Geoffrey S. Mruk
(74) *Attorney, Agent, or Firm*—Stroock & Stroock & Lavan LLP

(57) ABSTRACT

An ink cartridge has an ink sensor. A printer's control device transmits a detection command and specified detection condition to the cartridge by radio. In response to the detection command, a sensor controller actuates and vibrates the sensor under the specified detection condition. The sensor is attached to a resonance chamber disposed in an ink chamber. The vibration frequency the sensor is regulated by a resonance frequency of the resonance chamber. The resonance frequency is varied by ink in the resonance chamber. Resonance frequency detection specifies the presence or absence of ink in the resonance chamber and so the quantity of ink. The printer's control device receives the detection result with the detection condition from the cartridge, and checks whether detection was performed under the specified detection condition, to verify the detection result's validity.

12 Claims, 14 Drawing Sheets

U.S. PATENT DOCUMENTS

| | | | | |
|---|---|---|---|---|
| 6,016,519 | A * | 1/2000 | Chida et al. | 710/19 |
| 6,044,694 | A | 4/2000 | Anderson et al. | |
| 6,312,106 | B1 | 11/2001 | Walker | |
| 6,325,354 | B1 | 12/2001 | Hoen et al. | |
| 6,470,744 | B1 | 10/2002 | Usui et al. | |
| 6,536,861 | B1 | 3/2003 | Usui et al. | |
| 6,685,296 | B2 * | 2/2004 | Mochizuki et al. | 347/19 |
| 6,975,120 | B2 * | 12/2005 | Amini | 324/339 |
| 2001/0050017 | A1 | 12/2001 | Ohsawa et al. | |
| 2002/0012016 | A1 | 1/2002 | Wilson et al. | |
| 2002/0075340 | A1 | 6/2002 | Moriyama | |
| 2002/0105555 | A1 | 8/2002 | Tsukada et al. | |
| 2002/0170353 | A1 | 11/2002 | Usui et al. | |
| 2003/0043216 | A1 | 3/2003 | Usui et al. | |
| 2003/0117142 | A1 | 6/2003 | Amini | |
| 2003/0128245 | A1 * | 7/2003 | Walker | 347/7 |

FOREIGN PATENT DOCUMENTS

| | | | |
|---|---|---|---|
| EP | 0 668 165 | A3 | 8/1995 |
| EP | 0 683 052 | | 11/1995 |
| EP | 0 749 840 | | 12/1996 |
| EP | 0 840 098 | A2 | 5/1998 |
| EP | 0 840 098 | A3 | 5/1998 |
| EP | 1 053 877 | A1 | 11/2000 |
| EP | 1 060 895 | A1 | 12/2000 |
| EP | 1 066 967 | A2 | 1/2001 |
| EP | 1 066 967 | A3 | 1/2001 |
| EP | 1 114 726 | A1 | 7/2001 |
| EP | 1 164 021 | A2 | 12/2001 |
| EP | 1 164 021 | A3 | 12/2001 |
| EP | 1 164 024 | | 12/2001 |
| EP | 1 170 133 | A1 | 1/2002 |
| EP | 1 177 904 | | 2/2002 |
| EP | 1 213 148 | A1 | 6/2002 |
| JP | 63-247045 | | 10/1988 |
| JP | 02-196663 | | 8/1990 |
| JP | 08-164615 | | 6/1996 |
| JP | 09-141892 | | 6/1997 |
| JP | 10-305590 | | 11/1998 |
| JP | 2001-147146 | | 5/2001 |
| WO | 98/52762 | A2 | 11/1998 |
| WO | 98/52762 | A3 | 11/1998 |
| WO | 01/87626 | A1 | 11/2001 |

OTHER PUBLICATIONS

European Search Report for EP 3 015 624,3, mailed Nov. 15, 2004.
Partial European Search Report for Eur. Pat. Appln. 07001326.3-1251 (Mar. 19, 2007).

* cited by examiner

CARTRIDGE AND PRINTING APPARATUS

CROSS-REFERENCE TO RELATED APPLICATION

This application is a continuation of patent application Ser. No. 10/620,872, filed on Jul. 16, 2003, now U.S. Pat. No. 6,994,415.

BACKGROUND OF THE INVENTION

1. Field of the Invention

The present invention relates to a cartridge having a chamber to hold a recording material used for printing therein. More specifically the invention pertains to a technique of transmitting information between a cartridge with a built-in sensor and the cartridge with such a chamber.

2. Description of the Related Art

Various printers and printing apparatuses are widely used for printing; for example, printing apparatuses that eject inks onto printing paper for recording, such as ink jet printers, and printing apparatuses that use toners for printing. A cartridge set on such a printing apparatus has a chamber to hold a recording material like an ink or a toner therein. Management of the remaining quantity of the recording material is an important technique in the printing apparatus. While the printing apparatus counts and manages the consumed quantity by software, a proposed technique uses a sensor mounted on the cartridge for direct measurement (see, for example, Patent Laid-Open Gazette No. 2001-147146).

A variety of sensors may be applicable for the sensor mounted on the cartridge. When the recording material to be detected is a conductive ink, the sensor may measure an electric resistance to determine the remaining quantity of ink. The sensor may use a piezoelectric element located in a resonance chamber disposed in the chamber of holding the recording material to measure the resonance frequency of the piezoelectric element and thereby detect the presence or the absence of the recording material in the resonance chamber. The sensor may measure a temperature, a viscosity, a humidity, a particle size, a hue, a remaining quantity, or a pressure of the recording material, such as ink. In such measurements, a special sensor may be used according to the physical property to be measured. For example, when the physical property to be measured is the temperature, the sensor may be a thermistor or a thermocouple. When the physical property to be measured is the pressure, the sensor may be a pressure sensor.

In the prior art cartridge with such a sensor, the detection is carried out under a fixed detection condition and may not have a sufficiently high reliability. For example, when the sensor mounted on the cartridge detects the presence or the absence of the recording material held in the chamber, a variation in composition of the recording material may change the optimum detection condition. The prior art cartridge cannot sufficiently assure the reliability of the detection, unless the circuit structure for the detection is adjusted for the new optimum detection condition. Such adjustment of the circuit structure, however, takes much time and labor and undesirably increases the cost.

Another problem may arise in the prior art cartridge, when the detection result gives a binary signal, for example, representing the presence or the absence of ink. When the detection circuit breaks down to continuously output an identical value of the binary signal, the malfunction cannot be detected accurately. This causes the poor reliability of the detection result.

SUMMARY OF THE INVENTION

The object of the present invention is thus to solve the drawbacks of the prior art techniques discussed above and to provide a technique of flexibly handling a change in detection condition of a sensor mounted on a cartridge and thereby ensuring a sufficiently high reliability of a detection result.

In order to attain at least part of the above and the other related objects, the present invention is directed to a cartridge having a chamber to hold a recording material used for printing therein, the cartridge being mounted on a printing apparatus. The cartridge includes: a sensor that detects a state of the recording material held in the chamber; a condition reception module that receives an externally specified detection condition of the sensor; a detection module that carries out the detection under the specified detection condition; and an output module that outputs a result of the detection.

The cartridge of the invention has a sensor that detects the state of the recording material held in the chamber. In response to reception of the externally specified detection condition of the sensor, the cartridge carries out the detection under the specified detection condition. The cartridge does not use a fixed detection condition to detect the state of the recording material held in the chamber, but receives a specified condition suitable for the detection. This arrangement thus effectively enhances the accuracy of the detection.

In one preferable application of the invention, the output module of the cartridge outputs data corresponding to the specified detection condition, together with the result of the detection.

The cartridge of this application outputs the result of the detection, together with data corresponding to the specified detection condition (here the data includes the detection condition itself). This arrangement enables an outside of the cartridge, which has given the external specification of the detection condition, to verify the reliability of the detection result.

The recording material held in the chamber of the cartridge may be an ink of a predetermined color used for an ink jet printer or a toner used for a photocopier, a facsimile, or a laser printer.

The sensor may detect the presence or the absence of the recording material in the chamber or the remaining quantity of the recording material. The sensor may otherwise measure at least one of a temperature, a viscosity, a humidity, a particle size, a hue, a remaining quantity, and a pressure of the recording material.

In one preferable application of the invention, the output module of the cartridge outputs the result of the detection by radio communication. Adoption of the radio communication effectively enhances the degree of freedom in installation of the cartridge.

The sensor may be a piezoelectric element that has a varying resonance state with a variation in state of the recording material. The available procedure in this structure applies an excitation pulse to the piezoelectric element and measures a vibration of the piezoelectric element in response to the excitation pulse. The procedure detects the state of the recording material, based on a resonance state of the piezoelectric element. Here the resonance state is shown as a resonance frequency of the piezoelectric element. The resonance frequency represents a time required for at least one vibration of the piezoelectric element.

In the cartridge with the built-in sensor of the piezoelectric element, the detection condition may be given as the specified number of vibrations, which is used as a criterion to measure the time required for the vibration of the piezoelectric element. In this structure, the cartridge measures a time required for the specified number of vibrations, and outputs vibration-related data used for the measurement, together with the measured time.

The number of vibrations used as the detection condition may be specified by a position of a starting vibration, on which the measurement starts, and a position of a terminating vibration, on which the measurement ends. The vibration-related data may be specified as a time between the starting vibration and the terminating vibration, based on the position of the starting vibration and the position of the terminating vibration.

In one preferable embodiment, the cartridge has a memory that stores a parameter corresponding to the state of the recording material held in the chamber.

The cartridge may receive the specified detection condition and output the result of the detection by radio communication. For this purpose, in one preferable structure, the cartridge has a radio communication module that transmits data to and from an outside by radio communication.

The radio communication module typically has a loop antenna for such communication. In the course of communication, an electromotive force is induced in the antenna. The electromotive force induced in the antenna may be utilized to supply electric power into the cartridge. This does not require any battery or its equivalency to be mounted on the cartridge and thus desirably simplifies the structure of the cartridge.

Another application of the present invention is a printing apparatus, on which the cartridge of the invention discussed above is mounted.

The present invention is accordingly directed to a printing apparatus with a cartridge mounted thereon, where the cartridge has a chamber to hold a recording material used for printing therein. The cartridge includes: a sensor that detects a state of the recording material held in the chamber; a condition reception module that receives an externally specified detection condition of the sensor; a detection module that carries out the detection under the specified detection condition; and an output module that outputs a result of the detection.

The printing apparatus further includes: a condition specification module that specifies the detection condition; an input module that receives the result of the detection output from the output module of the cartridge; and a verification module that verifies the result of the detection.

The cartridge detects the state of the recording material under the detection condition specified by the printing apparatus, and outputs the result of the detection to the printing apparatus. The cartridge does not use a fixed detection condition to detect the state of the recording material held in the chamber, but receives a specified condition suitable for the detection. This arrangement thus effectively enhances the accuracy of the detection and ensures the sufficiently high reliability of the printing apparatus.

In one preferable application of the present invention, the output module of the cartridge outputs data corresponding to the specified detection condition, together with the result of the detection. The input module of the printing apparatus receives the output data, together with the result of the detection output from the output module of the cartridge. The verification module of the printing apparatus compares the input data with the detection condition specified by the condition specification module, verifies validity of the detection result in the case of correspondency of the input data to the specified detection condition, and carries out a preset series of processing relating to the state of the recording material.

The printing apparatus of this application compares the input data corresponding to the detection condition received from the cartridge with the specified detection condition. In the case of correspondency of the input data to the specified detection condition, the printing apparatus verifies the validity of the detection result and carries out a preset series of processing relating to the state of the recording material. In the structure of detecting the presence or the absence of the recording material, the preset series of processing may be computation of a remaining quantity of the recording material or calibration of an arithmetic expression for such computation. In the case of no correspondency of the input data to the specified detection condition, on the contrary, the printing apparatus may verify the invalidity of the detection result or give the user a warning of the invalid detection result.

The present invention is also directed to a first method of transmitting information to and from a cartridge, which has a chamber to hold a recording material used for printing therein. The first information transmission method includes the steps of: externally specifying a detection condition of a sensor, which is mounted on the cartridge and is used to detect a state of the recording material held in the chamber, from an outside of the cartridge; and making a result of detection, which is carried out in the cartridge by the sensor under the specified detection condition, output from the cartridge to the outside that has given the external specification.

The first information transmission method of the invention externally specifies the detection condition of the sensor from the outside of the cartridge, and makes a result of detection, which is carried out under the specified detection condition, output from the cartridge to the outside that has given the external specification.

The present invention is further directed to a second method of transmitting information to and from a cartridge, which has a chamber to hold a recording material used for printing therein. The second information transmission method includes the steps of: externally specifying a detection condition of a sensor, which is mounted on the cartridge and is used to detect a state of the recording material held in the chamber, from an outside of the cartridge; making data corresponding to the specified detection condition, together with a result of detection carried out in the cartridge by the sensor under the specified detection condition, output from the cartridge to the outside of the cartridge; and verifying a correspondency of the output data to the specified detection condition, so as determine validity of the detection result.

The second information transmission method of the invention externally specifies the detection condition of the sensor from the outside of the cartridge, and makes data corresponding to the specified detection condition, together with a result of detection, output from the cartridge to the outside of the cartridge. The method receives the result of detection and the output data and verifies the correspondency of the output data to the specified detection condition, so as to determine the validity of the detection result. This arrangement desirably enhances the reliability of information transmission from and to the cartridge.

These and other objects, features, aspects, and advantages of the present invention will become more apparent from the following detailed description of the preferred embodiment with the accompanying drawings.

DESCRIPTION OF THE PREFERRED EMBODIMENTS

Figure 1:
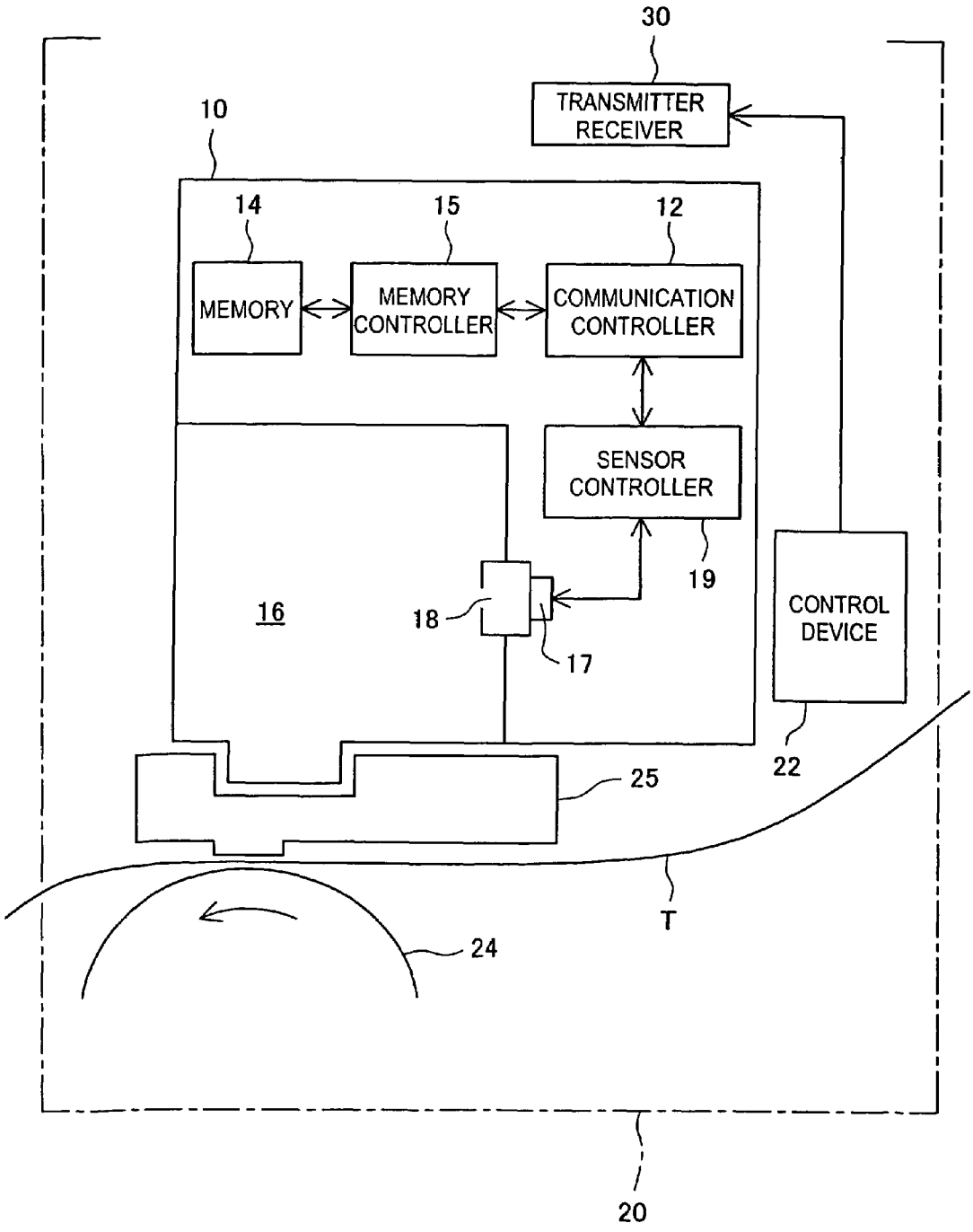
FIG. 1 schematically illustrates the construction of an ink cartridge in one mode of the present invention.

One mode of carrying out the invention is discussed below. FIG. 1 schematically illustrates the construction of an ink cartridge 10 and a transmitter receiver 30 of a printer 20, on which the ink cartridge 10 is mounted, in one mode of the present invention. The printer 20 causes ink to be ejected from a print head 25 onto a sheet of printing paper T fed by means of a platen 24. The internal structure of the printer 20 is not specifically illustrated or described here. A built-in control device 22 of the printer 20 computes the quantity of ink consumed for printing and other data and transmits the computed data to the ink cartridge 10 via the transmitter receiver 30. Transmission of data between the ink cartridge 10 and the control device 22 of the printer 20 is performed by radio communication in this mode, although the data transmission may alternatively be attained by cable communication. An electromagnetic induction method is applied for radio communication in this mode, but another method may be adopted for the same purpose.

The ink cartridge 10 has a communication controller 12 that takes charge of control of communication, a memory controller 15 that takes charge of operations of writing and reading data into and from a memory 14, a sensor 17 having a piezoelectric element, and a sensor controller 19 that actuates the sensor 17 and uses the sensor 17 to measure the remaining quantity of ink. The sensor 17 measures the remaining quantity of ink according to the following procedure. The sensor 17 is attached to a resonance chamber 18, which is disposed in an ink chamber 16. In response to application of a driving voltage to its electrode (not shown), the piezoelectric element of the sensor 17 is distorted and deformed. When the electric charges accumulated in the piezoelectric element are discharged in this state, the deformation energy is released and the piezoelectric element freely vibrates. The sensor 17 is attached to the resonance chamber 18, so that the frequency of the free vibration is restricted by the resonance frequency of the resonance chamber 18. The resonance frequency of the resonance chamber 18 is varied according to the presence or the absence of ink in the resonance chamber 18. Detection of the resonance frequency accordingly specifies the presence or the absence of ink in the resonance chamber 18 and the remaining quantity of ink in the ink cartridge 10.

Figure 2:
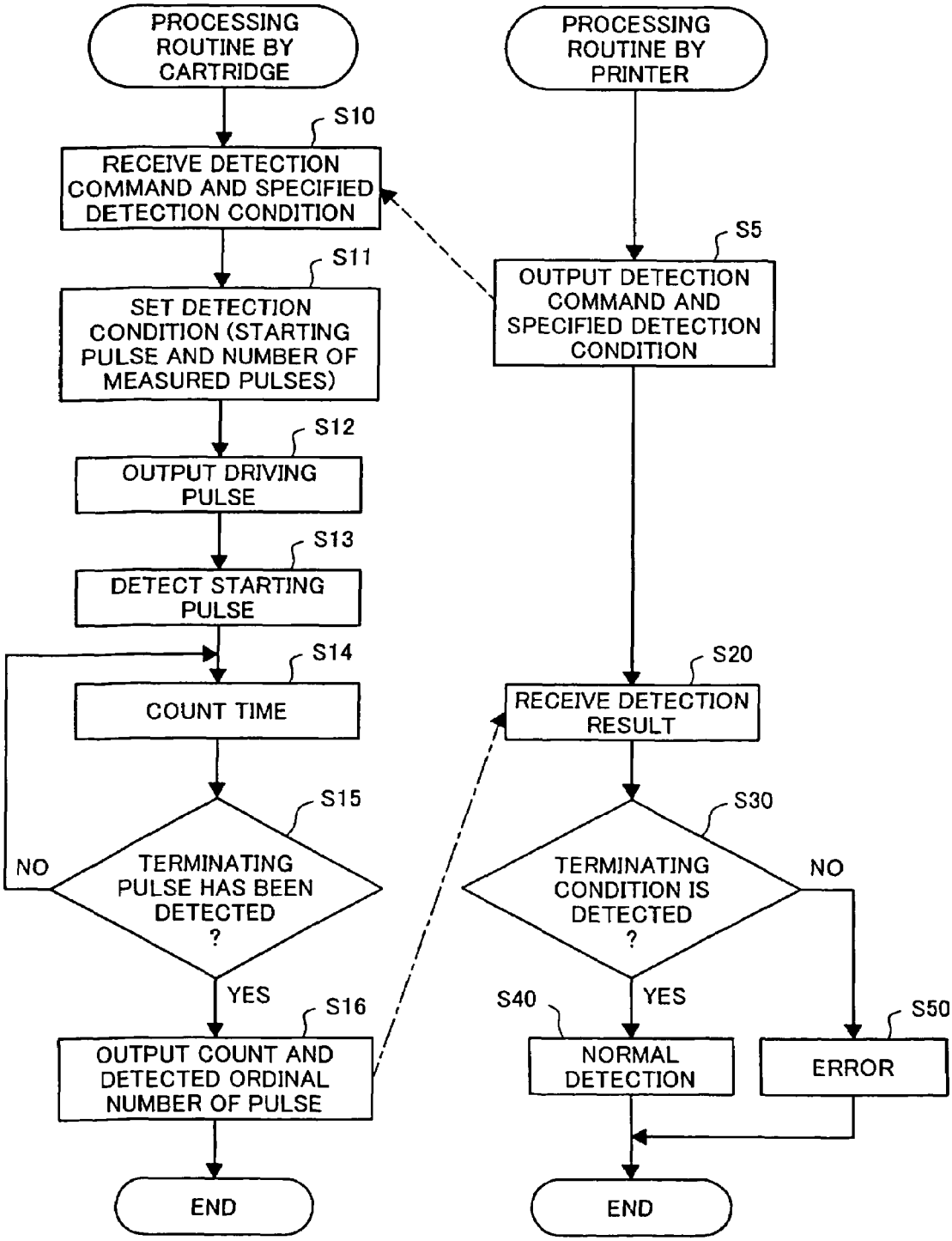
FIG. 2 is a flowchart showing series of processing executed by the ink cartridge and a printer in the mode of the invention.

FIG. 2 is a flowchart showing series of processing executed by the sensor controller 19 and by the control device 22 of the printer 20. The sensor controller 19 is actually constructed by a circuit including gate arrays. For the better understanding, the series of processing executed by the sensor controller 19 is described according to the flowchart of FIG. 2. The control device 22 of the printer 20 outputs a command of detecting the remaining quantity of ink and a specified detection condition (step S5). Specification of the detection condition will be discussed later in detail. The ink cartridge 10 receives the command of detecting the remaining quantity of ink and the specified detection condition via the communication controller 12 (step S10).

Figure 3:
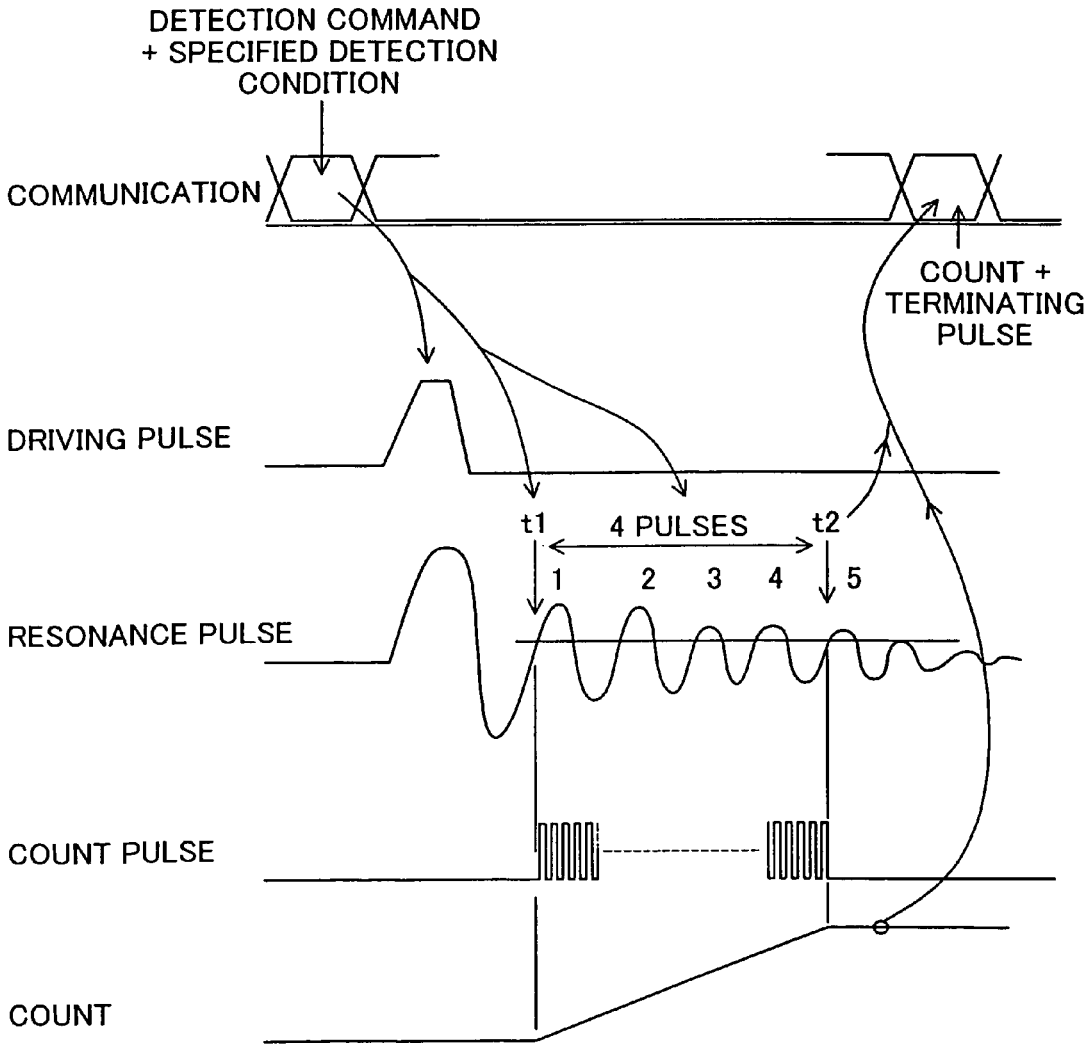
FIG. 3 shows the principle of detection of the presence or the absence of ink in the mode of the invention.

After reception of the specified detection condition, the sensor controller 19 sets a starting pulse, on which the measurement starts, and the number of measured pulses (step S11). As mentioned above, the resonance frequency is used for the detection. The setting of step S11 specifies the pulse in the vibration of the sensor 17 used for the measurement as the starting pulse and the number of pulses as the measured pulses. For example, the settings are the $1^{st}$ pulse as the starting pulse and 4 pulses as the number of measured pulses. Another procedure may alternatively specify the starting pulse and a terminating pulse, on which the measurement ends. In the above example, the terminating pulse is the $5^{th}$ pulse. FIG. 3 shows the starting pulse and the terminating pulse of the measurement and the number of measured pulses in the resonant vibration of the sensor 17.

On completion of the setting of the detection condition, the sensor controller 19 outputs a driving pulse to the sensor 17 (step S12). The sensor 17 of the piezoelectric element is accordingly excited to have vibrations and resonates at the varying resonance frequency with a variation in state of the resonance chamber 18 after disappearance of the applied voltage. The sensor controller 19 waits for detection of the starting pulse set as the detection condition (step S13), and starts counting time in response to detection of the starting pulse (at a timing t1 in the example of FIG. 3) (step S14).

The sensor controller 19 waits for detection of the terminating pulse or the preset number of pulses (for example, 4 pulses) at the step S15, and in response to detection of the terminating pulse or the preset number of pulses, stops counting the time and outputs the count (step S16). The sensor controller 19 also outputs the ordinal number of the pulse on which the measurement ends (at a timing t2 in the example of FIG. 3). The ordinal number of the pulse on which the measurement ends is obtained by adding the number of measured pulses (4 pulses in this example) to the starting pulse (the $1^{st}$ pulse of the resonance vibration in this example), and is equal to the $5^{th}$ pulse in the example of FIG. 3.

As the sensor controller 19 outputs the count and the detected ordinal number of the pulse via the communication controller 12, the control device 22 of the printer 20 receives this detection result (step S20) and checks the terminating condition of the detection (step S30). In this embodiment the control device 22 checks the ordinal number of the pulse input with the count to determine whether or not the ordinal number of the pulse matches with the specified detection condition. In the procedure of this mode, the controller 22 receives the ordinal number of the pulse corresponding to the position of the terminating pulse from the sensor controller 19 of the ink cartridge 10. The controller 22 accordingly calculates the position of the terminating pulse from the specified detection condition (step S5), compares the ordinal number of the pulse with the calculated position of the terminating pulse, and determines whether or not the ordinal number of the pulse matches with the specified detection condition. One modified procedure may specify the starting pulse and the terminating pulse, receive the number of measured pulses with the detection result, and determine whether or not the input number of measured pulses matches with the specified detection condition.

When it is determined at step S30 that the ordinal number of the pulse matches with the detection condition, the control device 22 of the printer 20 verifies the normal detection (step S40). The remaining quantity of ink detected by the sensor 17 is accordingly used for subsequent processing. For example, when the detection result represents the absence of ink in the resonance chamber 18, the controller 22 of the printer 20 determines that the remaining quantity of ink is below a preset level of the resonance chamber 18, and uses the detected remaining quantity of ink for subsequent management. When it is determined at step S30 that the ordinal number of the pulse does not correspond to the detection condition, on the contrary, the control device 22 of the printer 20 verifies the occurrence of an error in detection (step S50) and does not use the detection result for subsequent processing.

In the mode of the present invention discussed above, the ink cartridge 10 detects the state of ink in the chamber 16 (for example, the presence or the absence of ink) under the condition externally specified by the control device 22 of the printer 20 outside the ink cartridge 10. This arrangement does not set any fixed condition for the detection and thus flexibly handles the change in state. For example, the procedure flexibly handles a change in optimum detection condition due to a variation in composition of the ink held in the chamber 16. Data transmission between the ink cartridge 10 and the printer 20 is carried out by radio communication. There is accordingly no fair of any failed contact between the printer 20 and the ink cartridge 10 traveling in the course of printing. This structure thus ensures stable data transmission. In the structure of this mode, the ink cartridge 10 outputs the data relating to the externally specified detection condition together with the detection result. The controller 22 of the printer 20, which has specified the detection condition, verifies the detection result. This arrangement thus ensures the sufficiently high reliability of the detection as well as the data communication.

Figure 4:
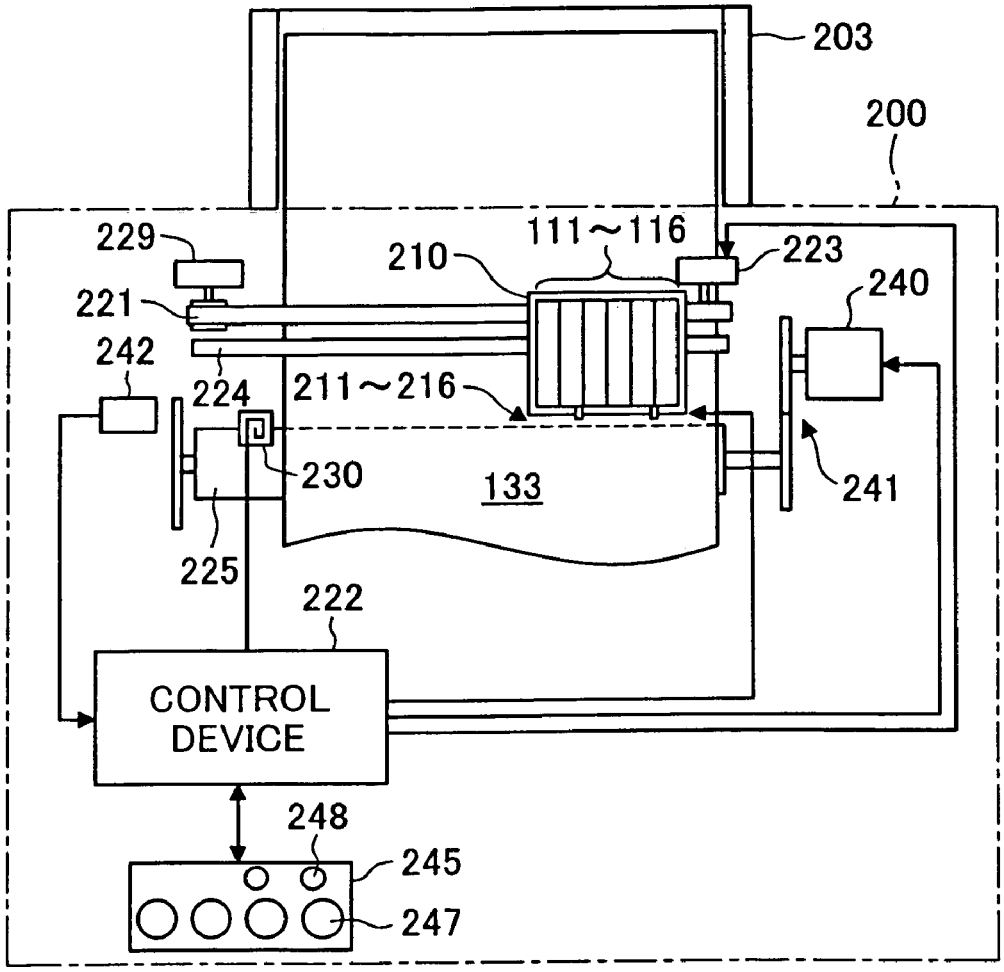
FIG. 4 schematically illustrates the internal structure of a printer in one embodiment of the present invention.
Figure 5:
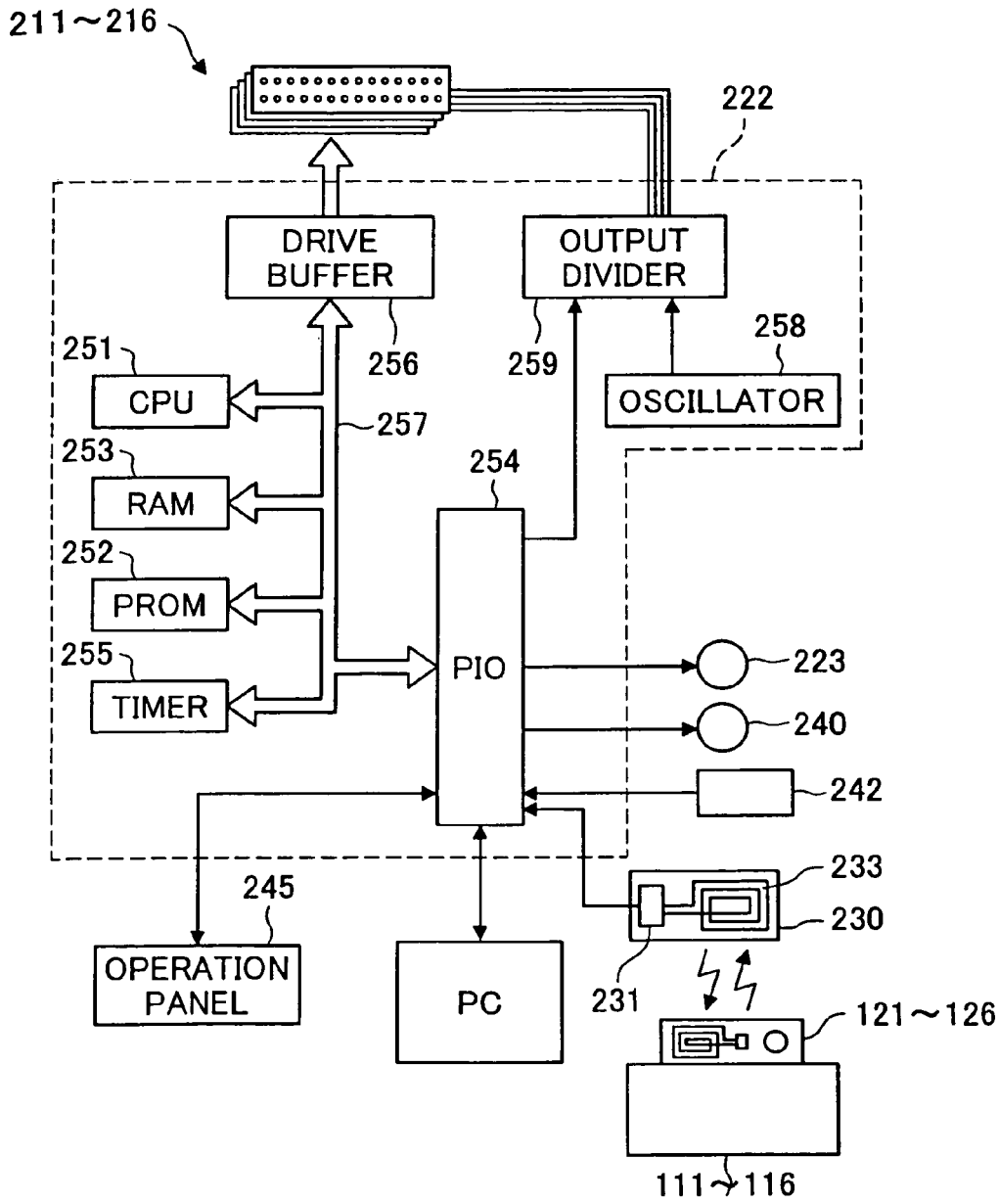
FIG. 5 is a block diagram showing the internal structure of a control device included in the printer of the embodiment.

One embodiment of the present invention is discussed below. The technique of the invention is applied to an ink jet printer 200 in this embodiment. FIG. 4 schematically illustrates the internal structure of the printer 200, especially the operation-related part. FIG. 5 shows the internal structure of a control device 222 of the printer 200. In the printer 200 of FIG. 4, as a sheet of printing paper T is fed from a paper feed unit 203 and is conveyed by means of a platen 225, inks are ejected from print head 211 through 216 onto the printing paper T to form an image. The platen 225 is driven and rotated by a driving force transmitted from a sheet feed motor 240 via a gear train 241. The rotational angle of the platen 225 is measured by an encoder 242. The print heads 211 through 216 are located on a carriage 210, which moves back and forth along a width of the printing paper T. The carriage 210 is connected with a conveyor belt 221 actuated by a stepping motor 223. The conveyor belt 221 is an endless belt and is spanned between the stepping motor 223 and a pulley 229 located on the opposite side. Rotation of the stepping motor 223 moves the conveyor belt 221 and makes the carriage 210 shift back and forth along a conveyor guide 224.

Ink cartridges 111 through 116 of six color inks are mounted on the carriage 210. The ink cartridges 111 through 116 of the six color inks basically have an identical structure and hold inks of different compositions, that is, different colors, in the respective built-in chambers. Black ink (K), cyan ink (C), magenta ink (M), yellow ink (Y), light cyan ink (LC), and light magenta ink (LM) are respectively held in the ink cartridges 111 through 116. The light cyan ink (LC) and the light magenta ink (LM) are adjusted to have approximately ¼ of the dye densities of the cyan ink (C) and the magenta ink (M) and are accordingly lighter in color than the cyan ink (C) and the magenta ink (M). Detection memory modules 121 through 126 (discussed later in detail) are attached to these ink cartridges 111 through 116. The detection memory modules 121 through 126 exchange data with the control device 222 of the printer 200 by radio communication. In the structure of this embodiment, the detection memory modules 121 through 126 are attached to the side faces of the ink cartridges 111 through 116.

The printer 200 has a transmitter receiver module 230 to make communication and exchange data with the detection memory modules 121 through 126 by wireless. The transmitter receiver module 230, as well as other electronic parts including the sheet feed motor 240, the stepping motor 223, and an encoder 242 are connected to the control device 222. Diverse switches 247 and LEDs 248 on an operation panel 245 on the front side of the printer 200 are also connected to the control device 222.

As shown in FIG. 5, the control device 222 has a CPU 251 that controls the operations of the whole printer 200, a ROM 252 that stores control programs executed by the CPU 251, a RAM 253 that is used for temporary storage of data, a PIO 254 that functions as an interface with external devices, a timer 255 that manages time, and a drive buffer 256 that accumulates data for actuating the print heads 211 through 216. These constituents are mutually connected via a bus 257. The control device 222 also has an oscillator 258 and an output divider 259, in addition to these circuit elements. The output divider 259 divides pulse signals output from the oscillator 258 into common terminals of the six print heads 211 through 216. The print heads 211 through 216 receive on-off data representing ink ejection or non-ejection from the drive buffer 256, and in response to reception of driving pulses from the output divider 259, eject inks from corresponding nozzles according to the on-off data.

Like the stepping motor 223, the sheet feed motor 240, the encoder 242, the transmitter receiver module 230, and the operation panel 245, a computer PC, which outputs object image data to be printed to the printer 200, is connected to the PIO 254 of the control device 222. The computer PC specifies image data to be printed, makes the specified image data subject to a series of processing including rasterization, color conversion, and halftoning, and outputs the processed image data to the printer 200. The printer 200 detects the shift position of the carriage 210 based on the measurement of the driving amount of the stepping motor 223, checks the sheet feed position based on the data from the encoder 242, expands the processed data received from the computer PC into on-off data of the inks to be ejected from the nozzles of the print heads 211 through 216, and actuates the drive buffer 256 and the output divider 259.

The control device 222 transmits data by wireless to and from the detection memory modules 121 through 126 mounted on the ink cartridges 111 through 116 via the transmitter receiver module 230 connecting with the PIO 254. The transmitter receiver module 230 accordingly has an RF converter 231 that converts the signal from the PIO 254 into an alternating current (AC) signal of a preset frequency and a loop antenna 233 that receives the AC signal from the RF converter 231. In the structure where a similar antenna is located near the loop antenna 233, application of the AC signal to the loop antenna 233 causes electromagnetic induction and excites the other antenna to generate an electric signal. In the structure of this embodiment, the wireless communicable range is restricted to the internal distance of the printer 200, so that the wireless communication technique using electromagnetic induction is adopted. The printer 200 and the ink cartridges 111 through 116 respectively have one antenna commonly used for reception and transmission in the structure of the embodiment, but an antenna for transmission may be separate from an antenna for reception in at least either the printer 200 or the ink cartridges 111 through 116. In the structure of the embodiment, the working electric power required for each of the ink cartridges 111 through 116 is supplied through electromagnetic induction between the antennas used for communication. Another antenna for supply of electric power may be provided separately.

Figure 6A:
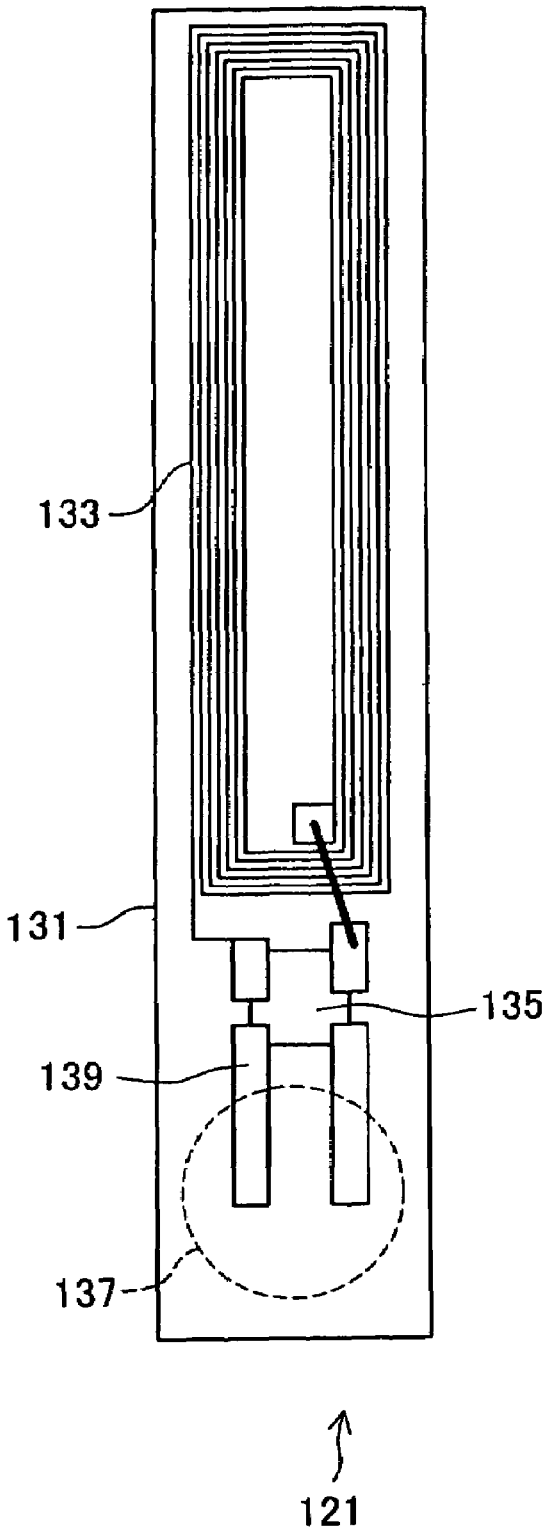
FIGS. 6A and 6B show the appearance of a detection memory module attached to an ink cartridge of the embodiment.
Figure 6B:
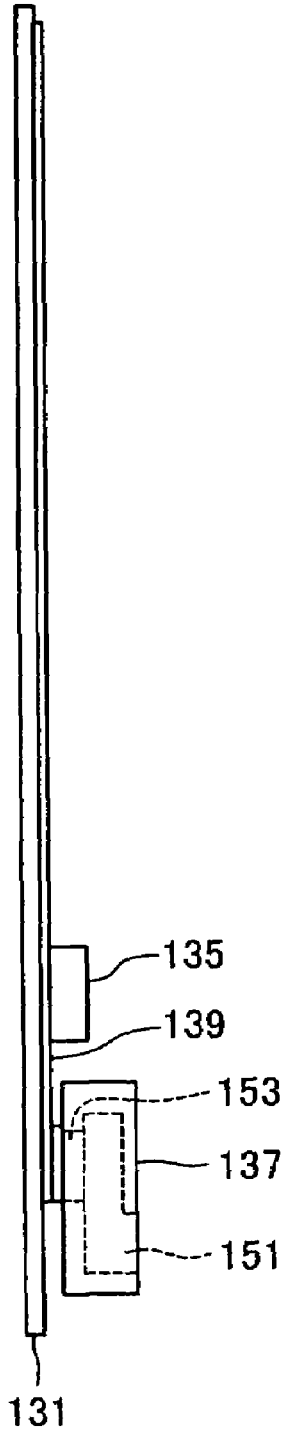

The structure of the detection memory module 121 attached to the ink cartridge 111 is discussed below. FIG. 6A is a front view and FIG. 6B is a side view showing the appearance of the detection memory module 121. The detection memory modules 121 through 126 mounted on the respective ink cartridges 111 through 116 have an identical structure, except the ID number stored therein. The following discussion regards only the detection memory module 121. The detection memory module 121 has an antenna 133 formed as a thin metal film pattern on a thin film substrate 131, an exclusive IC chip 135 having a diversity of functions (discussed later) installed therein, a sensor module 137 that detects the presence or the absence of ink, and a wiring pattern 139 that connects these elements.

Figure 7:
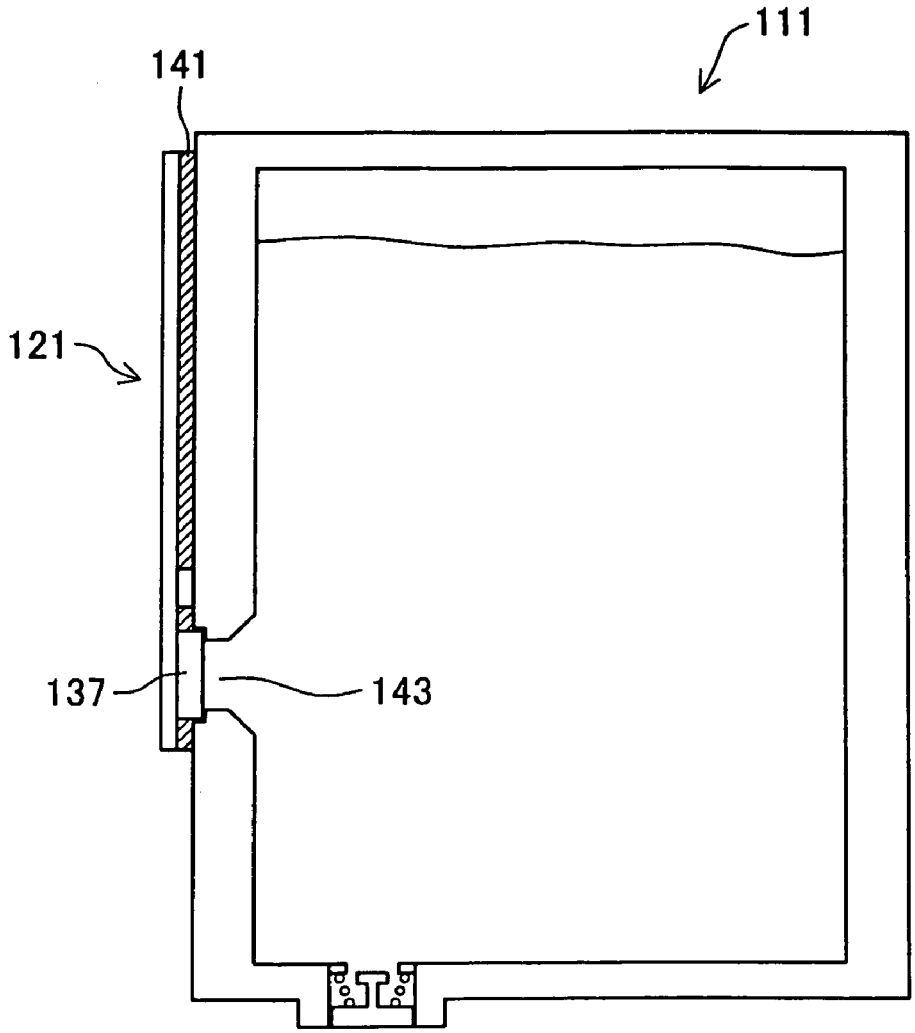
FIG. 7 shows attachment of the detection memory module to the ink cartridge.

FIG. 7 is an end view showing attachment of the detection memory module 121 to the ink cartridge 111. The detection memory module 121 is attached to the side face of the ink cartridge 111 via an adhesive layer 141 of, for example, an adhesive or a double-faced adhesive tape. The sensor module 137 located on the rear face of the substrate 131 is fit in an opening 143 formed in the side face of the cartridge 111. A resonance chamber 151 is formed inside the sensor module 137, and a piezoelectric element 153 working as a sensor is attached to one side wall of the resonance chamber 151.

Figure 8:
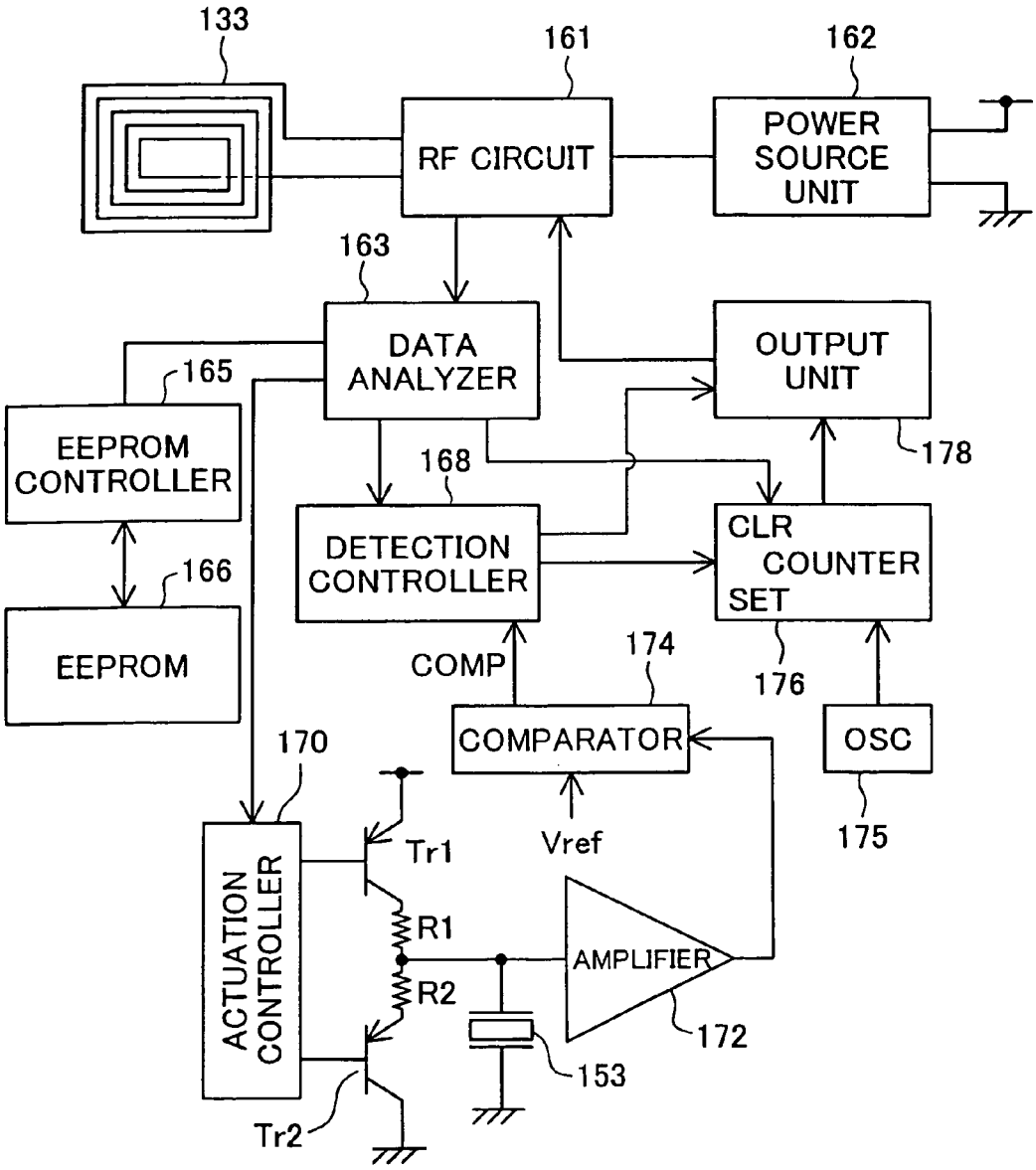
FIG. 8 is a block diagram showing the internal structure of the detection memory module.

The internal structure of the detection memory module 121 is described. FIG. 8 is a block diagram showing the internal structure of the detection memory module 121. The detection memory module 121 has an RF circuit 161, a power source unit 162, a data analyzer 163, an EEPROM controller 165, an EEPROM 166, a detection controller 168, an actuation controller 170, an amplifier 172, a comparator 174, an oscillator 175, a counter 176, an output unit 178, two transistors Tr1 and Tr2, and resistors R1 and R2, which are located inside a dedicated IC chip 135.

The RF circuit 161 demodulates and inputs the AC signal generated in the antenna 133 by electromagnetic induction, and outputs an electric power component taken out by the demodulation to the power source unit 162 and a signal component to the data analyzer 163. The RF circuit 161 also functions to receive a signal from the output unit 178 (discussed later), modulate the received signal into an AC signal, and transmit the AC signal to the transmitter receiver module 230 of the printer 200 via the antenna 133. The power source unit 162 stabilizes the electric power component input from the RF circuit 161 and outputs the stabilized electric power component as power supplies in the dedicated IC chip 135 and of the sensor module 137. No separate electric power, such as dry cells, is accordingly mounted on any of the ink cartridges 111 through 116. In the case where the supply time of the electric power in the form of the signal from the transmitter receiver module 230 is relatively restricted, the detection memory module 121 may desirably include a charge storage element, such as a capacitor, for accumulating the stabilized power source generated by the power source unit 162, although not being specifically illustrated. Such a charge storage element may be located before the power source unit 162.

Figure 9A:
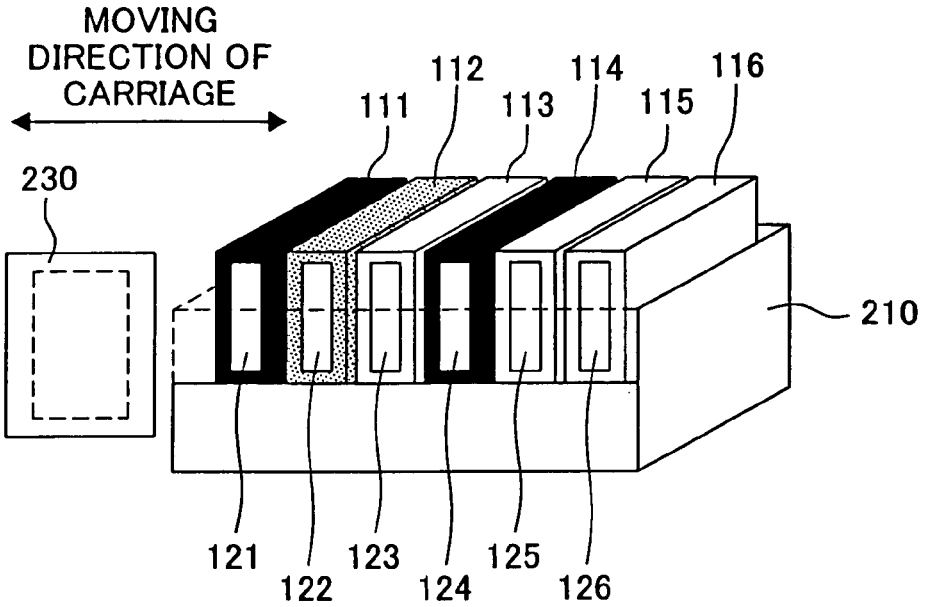
FIGS. 9A and 9B show the movement of ink cartridges mounted on a carriage relative to a transmitter receiver module in the printer of the embodiment.
Figure 9B:
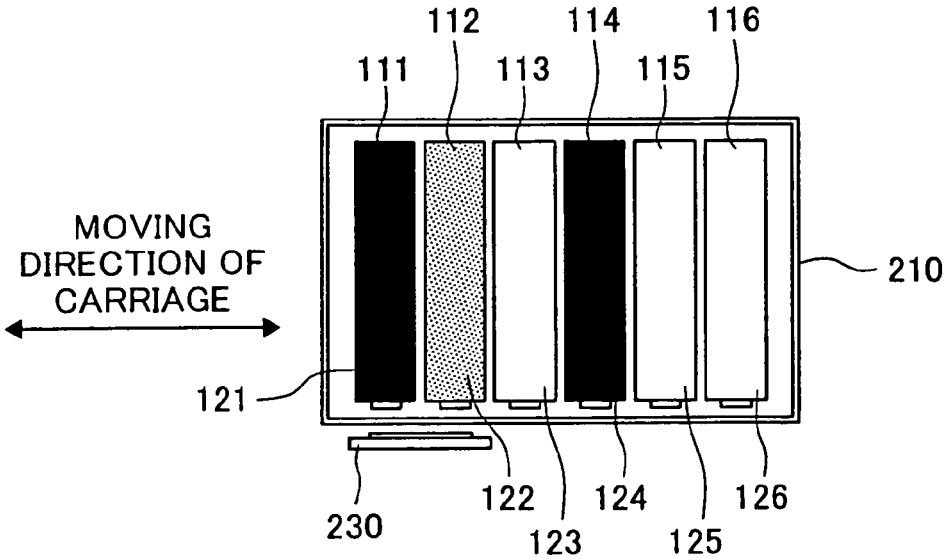

The data analyzer 163 analyzes the signal component input from the RF circuit 161 and mainly takes a command and data from the analyzed signal component. The data analyzer 163 carries out control to select either data transmission to and from the EEPROM 166 or data transmission to and from the sensor module 137, based on the result of the analysis. The data analyzer 163 also carries out a series of processing required for identification of the object ink cartridge currently involved in data transmission, in order to control data transmission to and from the EEPROM 166 or the sensor module 137 according to the result of the data analysis. The data analyzer 163 identifies the object ink cartridge, based on information regarding the relative positions of the respective ink cartridges 111 through 116 mounted on the carriage 210 to the transmitter receiver module 230 and IDs stored in the respective ink cartridges 111 through 116, as shown in FIGS. 9A and 9B. The details of this processing will be discussed later. FIG. 9A is a perspective view showing the positions of the ink cartridges 111 through 116 and the detection memory module 121 through 126 attached thereto to the transmitter receiver module 230. FIG. 9B shows the positional relations of the ink cartridges 111 through 116 to the transmitter receiver module 230 along their widths.

In the process of identifying the object ink cartridge, the control device 222 shifts the carriage 210 to the side where the transmitter receiver module 230 is located. The location of the carriage 210 facing the transmitter receiver module 230 is outside a printable range. As shown in FIGS. 9A and 9B, in the structure of this embodiment, the detection memory modules 121 through 126 are attached to the side faces of the ink cartridges 111 through 116. With the movement of the carriage 210, at most two detection memory modules enter a transmittable range to and from the transmitter receiver module 230. In this state, the data analyzer 163 receives a requirement from the control device 222 via the transmitter receiver module 230 and carries out required series of processing for identification of the object ink cartridge involved in data transmission, access to the memory, and data transmission to and from the sensor module 137. The details of the processing will be discussed later with reference to a flowchart.

After identification of the object ink cartridge involved in data transmission, in the case of data transmission to and from the EEPROM 166, the data analyzer 163 transmits an address used for a reading operation or a writing operation, specification of either the reading operation or the writing operation, and data in the case of the writing operation to the EEPROM controller 165. The EEPROM controller 165 receiving the address, the specification, and the data outputs the address and the specification of either the reading operation or the writing operation to the EEPROM 166 to read or write data from or into the EEPROM 166.

Figure 10A:
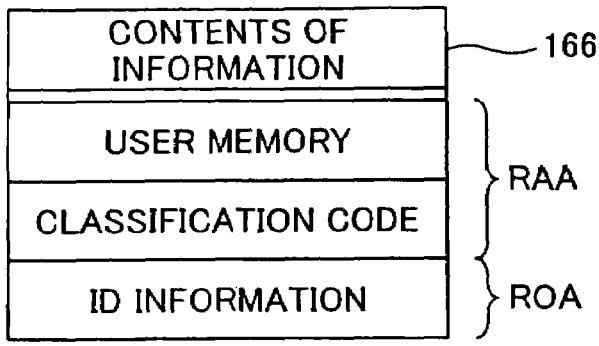
FIGS. 10A and 10B show information stored in an EEPROM included in the detection memory module.
Figure 10B:
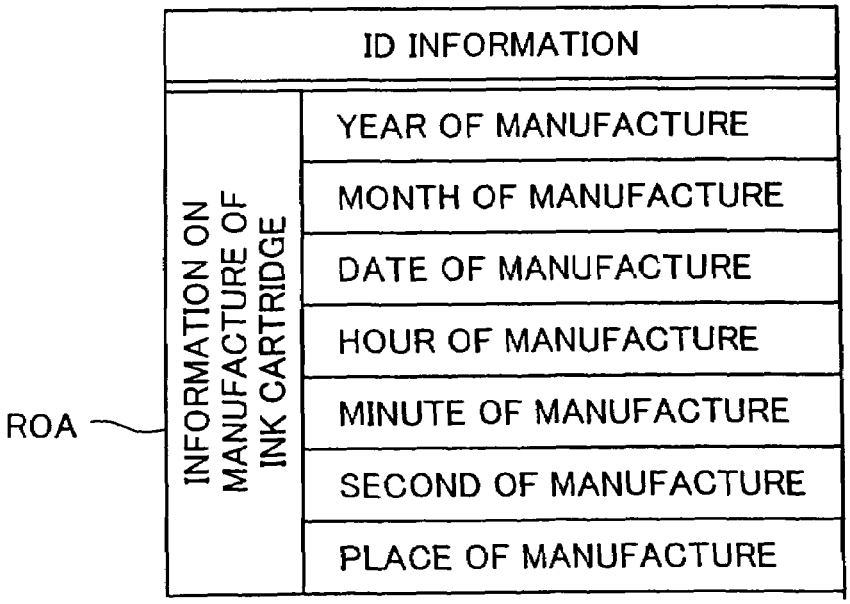

The data structure in the EEPROM 166 is shown in FIGS. 10A and 10B. As shown in FIG. 10A, the inside of the EEPROM 166 is roughly divided into two sections. The former half of the memory space is a readable and writable area RAA that includes a user memory used for reading and writing the remaining quantity of ink and other data and a memory area of classification code. The latter half of the memory space is a read only area ROA in which ID information used for identifying each ink cartridge is written.

The ID information is written into the read only area ROA prior to attachment of the detection memory modules 121 through 126 with the EEPROM 166 to the respective ink cartridges 111 through 116, for example, in the course of manufacturing the detection memory modules 121 through 126 or in the course of manufacturing the ink cartridges 111 through 116. The printer 200 is allowed to both read and write data from and into the readable and writable area RAA, while being allowed to only read data from the read only area ROA but being prohibited from writing data into the read only area ROA.

The user memory in the readable and writable area RAA is used to write information regarding the remaining quantity of ink in each of the ink cartridges 111 through 116. The printer 200 reads the information on the remaining quantity of ink and may give an alarm to the user when the remaining quantity of ink is below a preset level. Diverse codes for identifying the type and other factors of the ink cartridge are stored in the memory area of classification code in the readable and writable area RAA. The user may utilize these codes according to the requirements.

The ID information stored in the read only area ROA includes information on manufacture of each ink cartridge, to which the detection memory module is attached. Information on the year, month, the date, the hour, the minute, the second, and the place of manufacture of each of the ink cartridges 111 through 116 is stored as the ID information in the read only area ROA as shown in FIG. 10B. Each piece of information is written in a 4-bit to 8-bit memory area, and the ID information totally occupies a memory area of 40 bits to 70 bits. Immediately after the power supply to the printer 200 or at any suitable timing, the control device 222 of the printer 200 reads the ID information including the information on manufacture of the respective ink cartridges 111 through 116 from the detection memory modules 121 through 126. The control device 222 may give an alarm to the user, for example, when the ink cartridge is expired or when the remaining quantity of ink is below a preset level.

The contents of the information included in the EEPROM 166 of the detection memory module 121 are not restricted to the above description. Other pieces of information may also be included in the EEPROM 166 according to the requirements. The whole EEPROM 166 may be designed as a readable and writable area. For example, an electrically readable and writable memory, such as an NAND-type flash ROM, may be applied for the EEPROM 166 to store the ID information including the information on manufacture of the ink cartridge. In the structure of the embodiment, a serial-type memory is applied for the EEPROM 166.

In the case of data transmission to and from the sensor module 137, on the other hand, the data analyzer 163 clears the counter 176, receives a detection condition from the control device 222, and sets the received detection condition in the detection controller 168. In response to the setting of the detection condition, the detection controller 168 specifies the settings for measurement from which pulse (called starting pulse) to which pulse in the signal output from the piezoelectric element 153 of the sensor module 137. The data analyzer 163 then gives a command of outputting a driving signal to the actuation controller 170. The actuation controller 170 outputs a driving signal to the transistors Tr1 and Tr2 and applies a driving voltage to the piezoelectric element 153, in response to the command. The resonance consequently occurring in the piezoelectric element 153 is amplified by the amplifier 172 and is input into the comparator 174 to be converted into a rectangular pulse signal. The comparator 174 compares the output signal from the amplifier 172 with a preset reference voltage Vref and converts the output signal into a rectangular wave according to the result of the comparison.

The detection controller 168 receives the signal from the comparator 174 and asserts a SET terminal of the counter 176 to activate the counter 176 for a period of a specified number of pulses from a preset starting pulse. The counter 176 counts the pulses generated by the oscillator 175 in the active state of the SET terminal and outputs the resulting count to the output unit 178. The output unit 178 receives a condition value for detection from the detection controller 168, and outputs the resulting count transmitted from the counter 176 and this condition value for detection to the control device 222 via the RF circuit 161. In the structure of this embodiment, the condition value for detection is obtained as the sum of the number of measured pulses and the ordinal number of the starting pulse, that is, the ordinal number of the terminating pulse on which the measurement ends (the $5^{th}$ pulse in the illustrated example). The condition value may otherwise be the starting pulse and the number of measured pulses representing the measurement time. The output unit 178 may be incorporated in the data analyzer 163.

Figure 11:
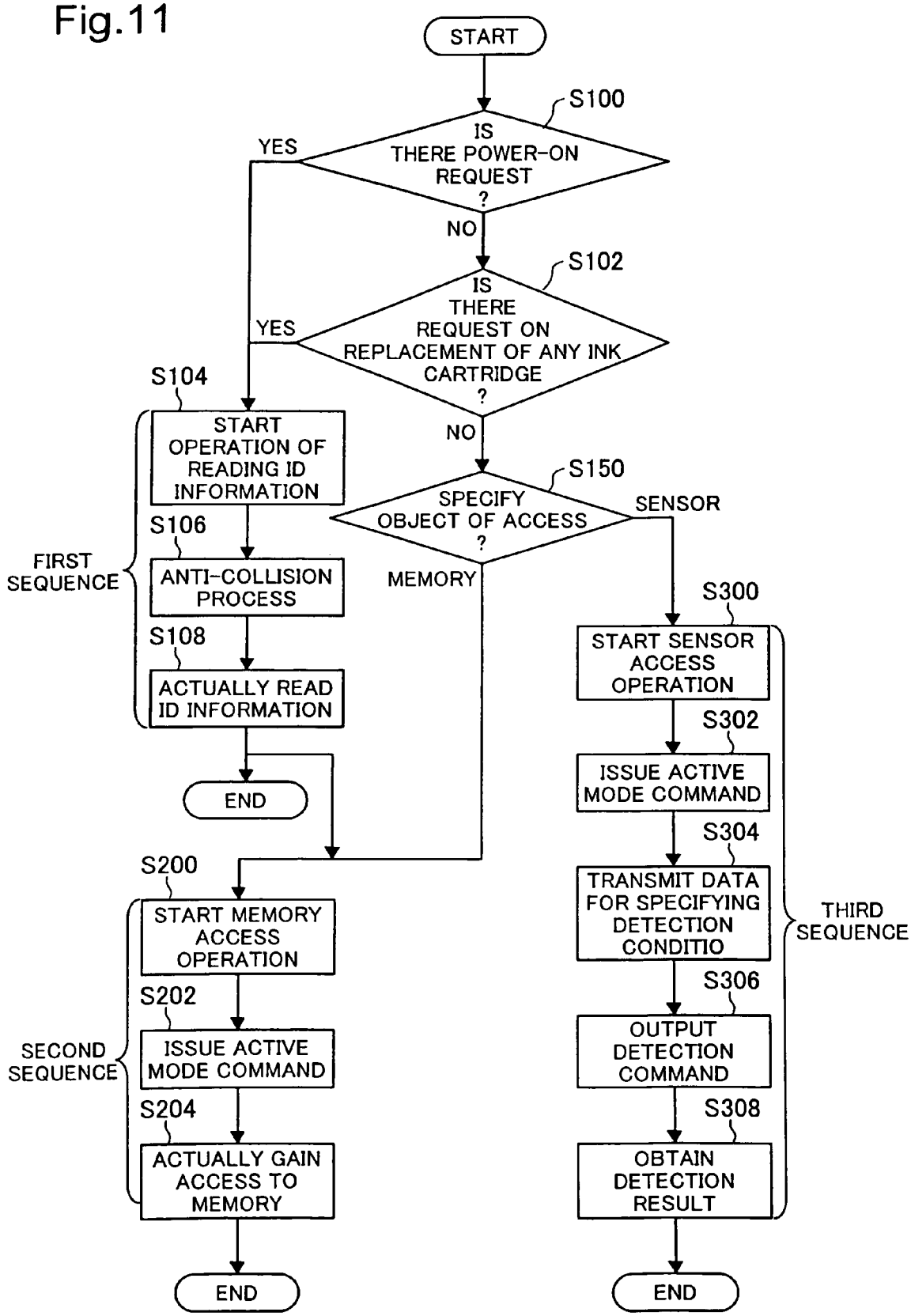
FIG. 11 is a flowchart showing a series of processing executed by the detection memory module in the embodiment.

The following describes the processing for identification of the ink cartridges 111 through 116 and the access to the memory, which is executed by the control device 222 of the printer 200 in cooperation with the data analyzers 163 of the detection memory modules 121 through 126. FIG. 11 is a flowchart showing a series of processing executed in communication via the transmitter receiver module 230 by the control device 222 of the printer 200 and the detection memory modules 121 through 126 of the ink cartridges 111 through 116. The control device 222 of the printer 200 and the data analyzers 163 of the respective detection memory modules 121 through 126 establish communication via the transmitter receiver module 230 and carry out a process of reading the ID information (first sequence), a process of gaining access to the memory to read data and information other than the ID information or write information on the remaining quantity of ink (second sequence), and a process of transmitting data to and from the sensor module 137 (third sequence).

At the time of power supply, at the time when the user replaces any of the ink cartridges 111 through 116 in the state of power supply, at the time when a preset time period has elapsed since execution of a previous communication process, or at any other suitable timing, the printer 200 reads the information on manufacture of the corresponding ink cartridge and writes or reads information on the remaining quantity of ink into or from the predetermined area of the EEPROM 166. These series of processing are different from the general printing process and are carried out in communication with the detection memory modules 121 through 126 via the transmitter receiver module 230.

In order to establish communication with the detection memory modules 121 through 126, the carriage 210 with the ink cartridges 111 through 116 mounted thereon is apart from a general printing execution position or from a right-side non-printing area and shifts to a left-side non-printing area, where the transmitter receiver module 230 is located. In response to the movement of the carriage 210 to the left-side non-printing area, each of the detection memory modules 121 through 126 approaching to the transmitter receiver module 230 receives the AC signal from the loop antenna 233 of the transmitter receiver module 230 via the antenna 133. The power source unit 162 takes the electric power component from the received AC signal and supplies the stabilized power source voltage to the respective controllers and circuit elements inside the detection memory module. The respective controllers and circuit elements in the detection memory module can thus perform the required processing.

On a start of the processing routine in communication of the transmitter receiver module 230 with the respective detection memory modules 121 through 126, the control device 222 of the printer 200 determines whether or not there is a power-on request (step S100). The processing of this step determines whether or not the printer 200 has just received power supply to start operations. When it is determined that there is a power-on request, that is, in the case of an affirmative answer at step S100, the first sequence starts to read the ID information from the detection memory modules 121 through 126 (step S104 and subsequent steps).

When it is determined that there is no power-on request, that is, in the case of a negative answer at step S100, on the other hand, the control device 222 determines that the printer 200 is executing the general printing process and subsequently determines whether or not there is a request on replacement of any of the ink cartridges 111 through 116 (step S102). The request on replacement of any of the ink cartridges 111 through 116 is given, in response to the user's press of an ink cartridge replacement button 247 on the operation panel 245 in the state of power supply to the printer 200. The printer 200 discontinues the general printing process to be ready for replacement of any of the ink cartridges 111 through 116. The request on replacement is output after actual replacement of any of the ink cartridges 111 through 116.

When it is determined that there is a request on replacement of any of the ink cartridges 111 through 116, that is, in the case of an affirmative answer at step S102, the control device 222 starts the first sequence to read the ID information from the detection memory module of the replaced ink cartridge (step S104). When it is determined that there is no request on replacement of any of the ink cartridges 111 through 116, that is, in the case of a negative answer at step S102, on the contrary, the control device 222 determines that the ID information has already been read correctly from the respective detection memory modules 121 through 126 at the time of power supply or at another adequate timing, and specifies the object of access (step S150). The ink cartridges 111 through 116 of the embodiment have two available objects of access, the EEPROM 166 (the memory) and the sensor module 137 (the sensor). When the object of access is the EEPROM 166, that is, in the case of the memory at step S150, the second sequence starts to gain access to the memory of the detection memory modules 121 through 126 (step S200). When the object of access is the sensor module 137, that is, in the case of the sensor at step S150, on the other hand, the third sequence starts to read the detection result from the sensor module 137 (step S300).

The first through the third sequences are described in detail. As mentioned above, the first sequence is executed when the control device 222 detects the power-on request of the printer 200 or the request on replacement of any of the ink cartridges 111 through 116. The first sequence starts an operation of reading the ID information from the detection memory modules 121 through 126 (step S104) and executes an anti-collision process (step S106). The anti-collision process is carried out to prevent interference in the process of reading the ID information from the respective detection memory modules 121 through 126. In the case of a failure in the middle of the anti-collision process, the anti-collision process is carried out all over again. In the structure of this embodiment taking advantage of radio communication, the transmitter receiver module 230 is capable of communicating simultaneously with multiple detection memory modules (two detection memory modules in this embodiment). At the time of starting communication, the control device 222 has not yet acquired the ID information from the detection memory modules 121 through 126 attached to the respective ink cartridges 111 through 116 mounted on the carriage 210. The anti-collision process is accordingly required to prevent the interference. In the anti-collision process, the transmitter receiver module 230 outputs part of the ID information, and only the detection memory module having the identical part of the ID information gives a response, whereas the other detection memory modules fall into a sleep mode. The control device 222 accordingly identifies the ID information of the detection memory module of the ink cartridge located in the communicable range and establishes communication with the detection memory module having the identical ID information. No further details of the anti-collision process are described here.

After the anti-collision process, the control device 222 actually reads the ID information from each of the detection memory modules 121 through 126 via the data analyzer 163 (step S108). On conclusion of the process of reading the ID information, the program exits from this communication process routine, or subsequently carries out the second sequence, according to the requirements.

When the program starts the second sequence, the control device 222 starts a memory access operation to gain access to the EEPROM 166 (step S200) and issues an active mode command to each of the detection memory modules 121 through 126 (step S202). The active mode command is output with the ID information to each of the detection memory modules 121 through 126. The data analyzer 163 in each of the detection memory modules 121 through 126 compares the received ID information with the stored ID information and transmits a response signal ACK representing a ready for access to the control device 222, only when the two pieces of ID information are identical with each other.

The control device 222 receives the response signal ACK to the issued active mode command from each of the detection memory modules 121 through 126, and actually executes the memory access operation to have access to the memory in each of the detection memory modules 121 through 126 (step S204). The memory access operation may write data into the EEPROM 166 or read data from the EEPROM 166. In either case, the EEPROM controller 165 receives the address of the memory specified by the control device 222 and gains access to the EEPROM 166. The EEPROM controller 165 reads or writes data from or into the specified address in the EEPROM 166, based on the specified address and specification of either the reading operation or the writing operation. On conclusion of the memory access operation to the EEPROM 166, the EEPROM controller 165 transmits a response signal ACK representing a completed access and the accessed address to the control device 222 via the data analyzer 163. The second sequence is here terminated to end, for example, the operation of writing the information on the remaining quantities of inks into the respective detection memory modules 121 through 126.

Figure 12:
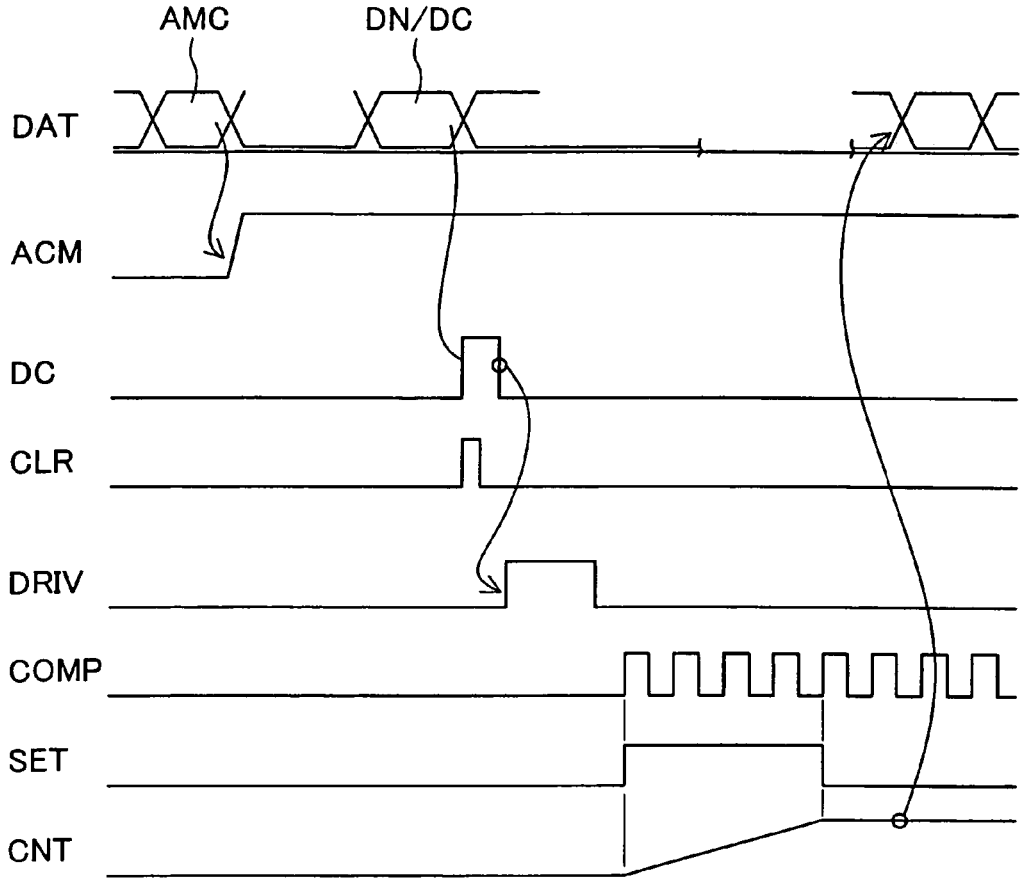
FIG. 12 is a timing chart showing the operations of the respective constituents of the printer according to a third sequence.

When the program starts the third sequence, the control device 222 starts a sensor access operation to gain access to the sensor module 137 (step S300) and issues an active mode command AMC to each of the detection memory modules 121 through 126 (step S302), as in the case of the memory access operation. Each of the detection memory modules 121 through 126 attached to the ink cartridges 111 through 116 receives the active mode command AMC and identifies the ID information received with the active mode command AMC. Only when the received ID information is identical with the stored ID information, the corresponding detection memory module sends back a response signal AC and is allowed to proceed to the subsequent processing. This process is shown in the timing chart of FIG. 12. The upper-most row DAT in FIG. 12 represents data transmission between the control device 222 and the detection memory module 121. A rise of the active mode command ACM to the high level shows that the detection memory module 121 is set in the active mode.

After the output of the active mode command AMC to activate one of the detection memory modules 121 through 126, the control device 222 transmits data DN for specifying the detection condition to the activated detection memory module (step S304). The activated detection memory module receives the data DN for specifying the detection condition and sends back a response signal ACK. The control device 222 then outputs a detection command DC, in response to the response signal ACK (step S306). The detection command DC may be included in the data DN for specifying the detection condition.

Figure 13:
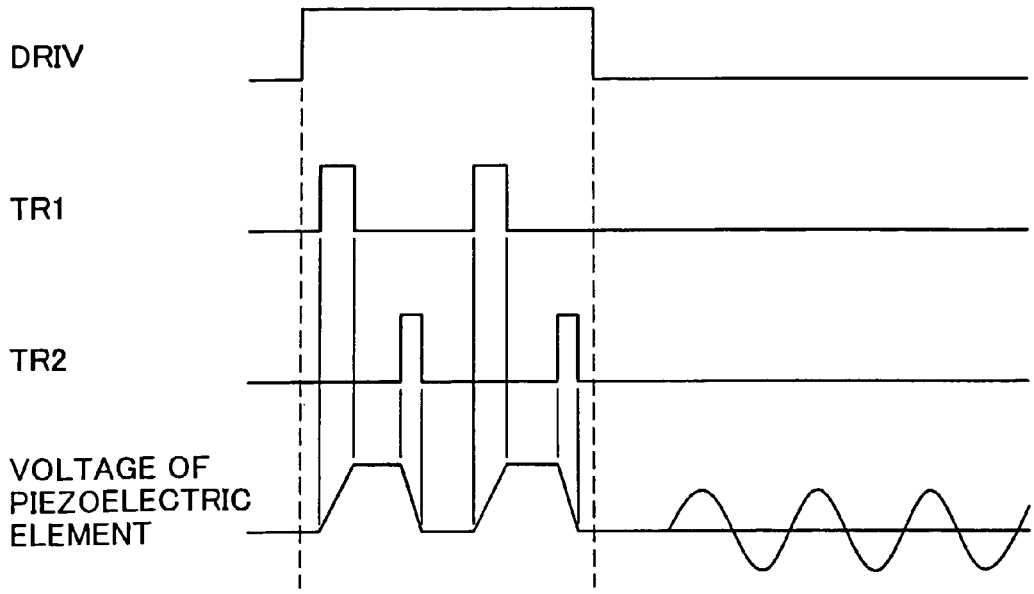
FIG. 13 shows a voltage actually applied to a piezoelectric element in response to a drive command DRIV and a vibration occurring in the piezoelectric element.

In response to reception of the detection command DC, the data analyzer 163 outputs a clear signal CLR to the counter 176 to reset the value on the counter 176 to '0' (see FIGS. 8 and 12). The data analyzer 163 subsequently outputs a drive command DRIV to the actuation controller 170. The actuation controller 170 receives the drive command DRIV to actuate the transistors Tr1 and Tr2. As shown in the timing chart of FIG. 13, the drive command DRIV repeats the following transistor on-off cycle twice: turning ON the transistor Tr1 for charging to apply a voltage to the piezoelectric element 153, turning OFF the transistor Tr1 and turning ON the other transistor Tr2 for discharging after elapse of a preset first time period, and turning OFF the transistor Tr2 after elapse of a preset second time period. The voltage applied to the piezoelectric element 153 is supplied from the power source unit 162, and the gradient of charge is restricted by the resistor R1. The electric charges accumulated in the piezoelectric element 153 are discharged via the transistor Tr2. The gradient of discharge is restricted by the resistor R2. The on-off intervals of the transistors Tr1 and Tr2 are set to make the frequency of the vibration generated in the piezoelectric element 153 close to the resonance frequency of the resonance chamber 151 included in the sensor module 137.

As the result of the charge and discharge by means of the actuation controller 170, the piezoelectric element 153 vibrates at a frequency close to the resonance frequency of the resonance chamber 151. A voltage, due to the vibration, is then generated on the electrode of the piezoelectric element 153. The vibration basically has the resonance frequency determined according to the property of the resonance chamber 151. The property of the resonance chamber 151 here represents the level of ink remaining in the resonance chamber 151. In this embodiment, the resonance frequency is approximately 90 KHz when the resonance chamber 151 is completely filled with ink, and is approximately 110 KHz when the ink in the resonance chamber 151 is used up by printing. The resonance frequency is varied according to the size of the resonance chamber 151 and the properties of its inner wall, such as the water repellency. The resonance frequency is thus measured for each type of the ink cartridge. The resonance frequency of the resonance chamber 151 prior to filling the ink cartridge with ink (that is, under the condition of the perfect vacancy of the resonance chamber 151) is slightly different from the resonance frequency of the resonance chamber 151 that is vacant by consumption of the filled ink. This may be ascribed to the small remains of ink on the inner wall of the resonance chamber 151 even after consumption of the ink. In the case of detecting the remaining quantity of ink in the resonance chamber 151 based on the frequency of the vibration of the piezoelectric element 153, the detection condition may be under considerable restriction.

The piezoelectric element 153 vibrates at the frequency close to the resonance frequency of the resonance chamber 151, which is triggered by the forced vibration under the applied voltage, as described above. The vibration is amplified by the amplifier 172, is input into the comparator 174, and is compared with a reference voltage Vref. The comparator 174 outputs a rectangular wave signal COMP having the frequency of the piezoelectric element 153, based on the result of the comparison (see FIG. 12). The detection controller 168 inputs this rectangular wave signal COMP and generates a set signal SET, which specifies a time period to activate the counter 176 for detection, based on the input rectangular wave signal COMP and the specified detection condition (the starting pulse and the number of measured pulses). In the illustrated example of FIG. 12, the starting pulse is a $1^{st}$ pulse, and the measurement time corresponds to 4 pulses. The detection time period, when the set signal SET is in the active state, is accordingly from a rise of the $1^{st}$ pulse to a rise of a $5^{th}$ pulse, that is, 4 pulses of the rectangular wave signal COMP.

While the set signal SET is in the active state, the counter 176 counts the pulses of the rectangular wave signal COMP by utilizing pulses of a high frequency output from the oscillator 175. The output time of 4 pulses is varied with a variation in resonance frequency. The counter 176 counts up until the set signal SET output from the detection controller 168 is inverted in response to detection of the terminating pulse. A resulting count CNT on the counter 176 is thus varied with the variation in resonance frequency. The count CNT is output to the control device 222 of the printer 200 via the output unit 178. The output unit 178 outputs data corresponding to the detection condition, as well as the count CNT, to the control device 222. In the structure of this embodiment, the data corresponding to the detection condition is the ordinal number of the terminating pulse (the $5^{th}$ pulse in the example of FIG. 12). The specified detection condition itself, that is, the ordinal number of the starting pulse (the $1^{st}$ pulse in the example of FIG. 12) and the number of measured pulses (4 pulses in the example of FIG. 12), may alternatively be output with the count CNT.

The control device 222 receives the count CNT as the detection result and the data corresponding to the detection condition (the ordinal number of the terminating pulse) and determines the remaining quantity of ink, based on the received count CNT. The actual procedure determines the presence or the absence of ink in the resonance chamber 151. The control device 222 determines the presence of ink in the resonance chamber 151 when the count CNT is greater than a preset reference level while determining the absence of ink in the resonance chamber 151 when the count CNT is not greater than the preset reference level. The control device 222 of the printer 200 counts the number of ink droplets ejected from each of the print heads 211 through 216 by the software counter and calculates the ink consumption for the purpose of management. The control device 222 can accurately manage the current level of ink in each of the ink cartridge 111 through 116, based on the calculated ink consumption and the information regarding the presence or the absence of ink in the resonance chamber 151 obtained from each of the detection memory modules 121 through 126 attached to the ink cartridges 111 through 116.

In the structure of managing the remaining quantity of ink based on the count of ink ejection, the calculated remaining quantity of ink is deviated from the actual remaining quantity of ink, since the quantity of ink ejected at a time from the nozzles in each of the print heads 211 through 216 is varied with variations in nozzle diameter, in viscosity of ink, and in working temperature of ink. Substantially no ink remains in the resonance chamber 151, when almost half of the ink is consumed in each of the ink cartridges 111 through 116. One preferable procedure detects the timing when the determination regarding the presence or the absence of ink in the resonance chamber 151 by each of the detection memory modules 121 through 126 is changed from the state of 'presence' to the state of 'absence' and corrects the computed ink consumption from the count by the software counter at the detected timing. This allows for accurate management of ink consumption. The correction may simply reset the quantity of ink consumption to ½ of the ink capacity, based on the detection result of the corresponding detection memory module, or may modify the count by the software counter. This arrangement enables the ink-end timing (the timing when the ink in each ink cartridge is completely used up) to be adequately estimated in each of the ink cartridges 111 through 116. Such adequate estimation effectively minimizes the waste of the valuable resource, due to the remains of non-used ink in the ink cartridge replaced in response to detection of the ink end. This also desirably prevents the ink in the ink cartridge from being used up prior to detection of the ink end, which causes hitting without ink and may damage the print head.

In the structure of this embodiment, the printer 200 transmits the data corresponding to the detection condition (the ordinal number of the terminating pulse), together with the count CNT as the detection result, to the control device 222 via each of the detection memory modules 121 through 126. The control device 222 can thus verify detection has been carried out accurately under the specified detection condition. When it is determined that detection has not been carried out under the detection condition specified by the control device 222, the count CNT given as the detection result is not reliable. The procedure accordingly does not carry out determination of the presence or the absence of ink or correction of the quantity of ink consumption, based on the count CNT. The procedure may otherwise carry out the correction while giving an alarm to the user, and use the result of the correction only for limited purposes. In the case of mismatch of the detection condition, the procedure may detect a failure of the detection memory module on the ink cartridge and advise the user to replace the ink cartridge.

Figure 14:
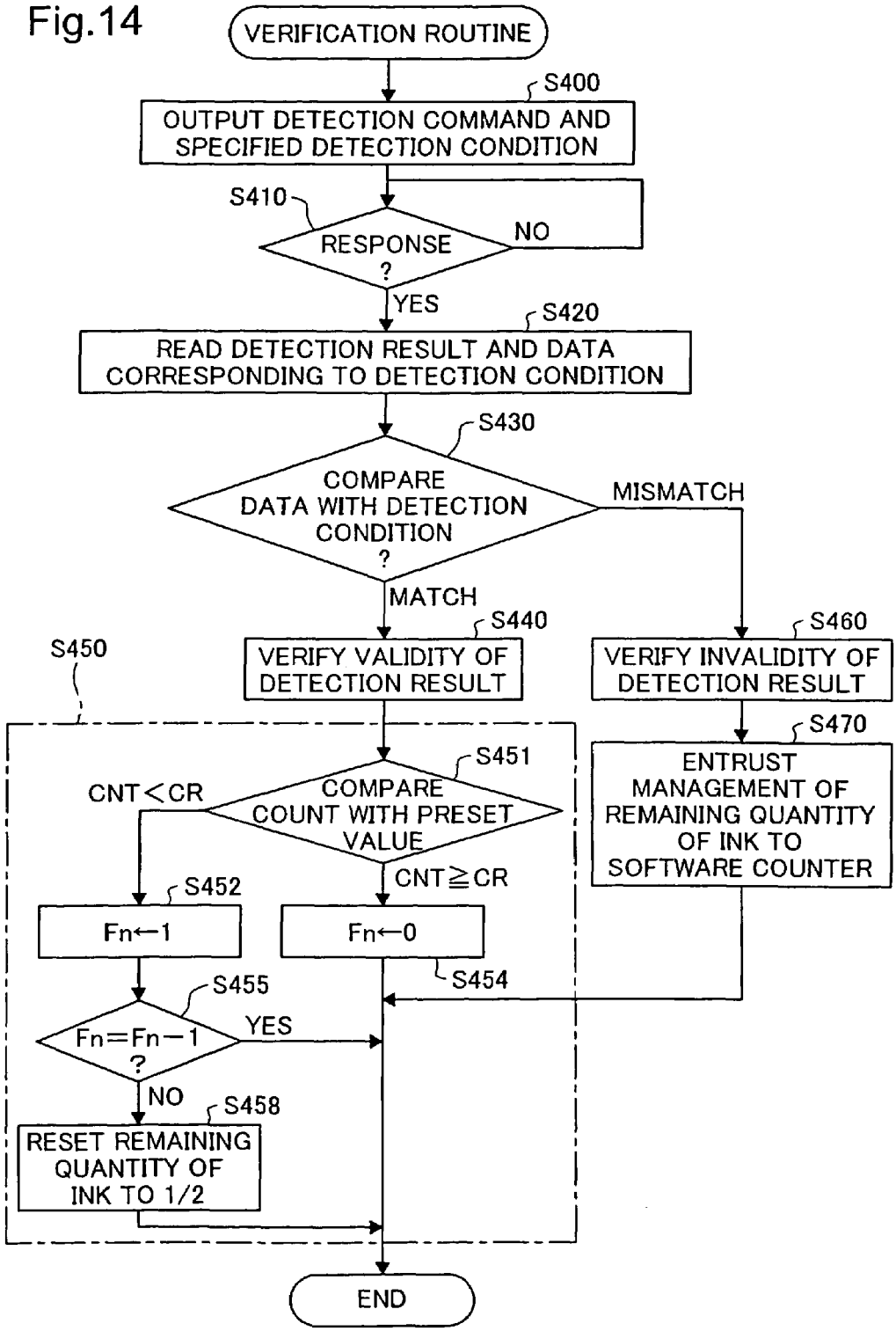
FIG. 14 is a flowchart showing a verification routine executed in the embodiment.

The control device 222 verifies detection has been carried out accurately under the specified detection condition according to a processing routine shown in the flowchart of FIG. 14. When the program enters this verification routine, the control device 222 transmits a specified detection condition D1 regarding the presence or the absence of ink and a detection command D2 to each of the detection memory modules 121 through 126 attached to the ink cartridges 111 through 116 (step S400), and waits for a response of the detection result from any of the detection memory modules 121 through 126 of the ink cartridges 111 through 116 (step S410). The control device 222 receives the detection result (the count CNT) and data DT corresponding to the detection condition D1 from any of the detection memory modules 121 through 126 of the ink cartridges 111 through 116 by radio communication (step S420).

The received data DT is then compared with the specified detection condition D1 (step S430). When the received data DT matches with the specified detection condition D1, the control device 222 verifies the validity of the detection result (step S440) and makes the detection result reflected on the computation of the remaining quantity of ink by the software counter (step S450). The concrete procedure of the processing at step S450 compares the count CNT given as the result of the measurement by the sensor module 137 with a preset value (step S451), and sets a value '1' to a flag Fn when the count CNT is smaller than the preset value while setting a value '0' to the flag Fn when the count CNT is not smaller than the preset value (steps S452 and S454). Only when the count CNT is smaller than the preset value, the procedure compares the value of a previously set flag Fn-1 with the value of the currently set flag Fn (step S455). In the case of mismatch, it means that the flag Fn has just been changed from the value '0' to the value '1'. The procedure accordingly determines that the remaining quantity of ink in the ink cartridge has just reached almost ½ of the ink capacity and corrects the computation of the remaining quantity of ink executed by the control device 222. Namely the control device 222 resets the calculated remaining quantity of ink to ½, based on the detection result (step S458).

Even when the computation of the remaining quantity of ink from the count by the software counter has some error, this arrangement desirably corrects the computation with the detection result regarding the remaining quantity of ink by the sensor module 137. One preferable procedure may carry out fine adjustment of a correction coefficient in the arithmetic expression used for computation of the remaining quantity of ink from the count by the software counter, by referring to the detection result regarding the remaining quantity of ink by the sensor module 137.

When it is determined at step S430 that the received data DT mismatches with the specified detection condition D1, on the other hand, the control device 222 verifies the invalidity of the detection result (step S460) and entrusts subsequent management of the remaining quantity of ink to the software counter (step S470). In this case, it is expected that there is some trouble in the corresponding one of the detection memory modules 121 through 126 attached to the ink cartridges 111 through 116. The control device 222 may thus give an alarm representing 'There may be a trouble in the ink cartridge' to the user. The alarm may be given by flashing an LED 248 on the operation panel 245 of the printer 200, by displaying a preset message on, for example, a liquid crystal display of the printer 200, or by outputting a voice alarm, for example, by synthetic voice, from a speaker connecting with the printer 200. In the case where the printer 200 is connected with a computer, which outputs print data to the printer 200, via a bidirectional interface, the printer 200 may output alarm data to the computer to give an alarm on the computer. On completion of the above series of processing, the program goes to 'END' and exits from the verification routine of FIG. 14.

As described above, the procedure of the embodiment checks the operations of the detection memory modules 121 through 126 attached to the respective ink cartridges 111 through 116 and modifies the processing (for example, computation of the remaining quantity of ink) according to the state of ink in each of the ink cartridges 111 through 116 set in the printer 200. When it is determined that each of the detection memory modules 121 through 126 is normally operated, the procedure may correct the computation of the remaining quantity of ink from the count by the software counter with the detection result at the time when the remaining quantity of ink reaches ½ of the ink capacity. When it is determined that detection has not been carried out under the detection condition specified by the control device 222, on the other hand, the count CNT given as the detection result is not reliable. The procedure accordingly does not carry out determination of the presence or the absence of ink or correction of the quantity of ink consumption, based on the count CNT. The procedure may otherwise carry out the correction while giving an alarm to the user, and use the result of the correction only for limited purposes. In the case of mismatch of the detection condition, the procedure may detect a failure of the detection memory module on the ink cartridge and advise the user to replace the ink cartridge.

In the structure of the above embodiment, the control device 222 of the printer 200 executes the first through the third sequences in the course of communication of the transmitter receiver module 230 with each of the detection memory modules 121 through 126 attached to the ink cartridges 111 through 116. The control device 222 verifies the validity of the detection result from each of the detection memory modules 121 through 126 and makes the detection result reflected on the computation of the remaining quantity of ink. These series of processing are executed, while the control device 222 establishes communication with each of the detection memory modules 121 through 126. The object of communication is successively shifted one by one from the detection memory module 121 on the left end to the detection memory module 126 on the right end. The carriage 210 thus successively moves by the width of each ink cartridge and stops there. While the carriage 210 is at a stop, the control device 222 establishes communication with the detection memory module of the corresponding ink cartridge. As mentioned previously, the transmitter receiver module 230 of this embodiment has the size substantially corresponding to the total width of two ink cartridges. The preferable procedure successively shifts the carriage 210 by the total width of two ink cartridges and causes the control device 222 to establish communication with two detection memory modules at each stop position. This advantageously reduces the number of shifting and positioning operations of the carriage 210. The control device 222 carries out the anti-collision process, so that there is no fair of the interference in data transmission from and to the multiple ink cartridges.

The above embodiment is to be considered in all aspects as illustrative and not restrictive. There may be many modifications, changes, and alterations without departing from the scope or spirit of the main characteristics of the present invention. For example, the detection memory module of the above embodiment is not restricted to the ink cartridge of the ink jet printer but is also applicable to a toner cartridge. The detection memory module may be attached to the bottom face or the top face of the ink cartridge. Arrangement of the detection memory module on the top face of the ink cartridge advantageously heightens the degree of freedom in location of the transmitter receiver module 230 and simplifies the structure of the whole ink cartridge. When the detection memory module is located on the top face of the ink cartridge, adequate division of the ink chamber ensures arbitrary setting of the remaining quantity of ink as the timing for detection of the presence or the absence of ink, for example, the timing with the ink consumption of approximately ½ or the timing close to ink end.

The procedure of the above embodiment detects the presence or the absence of ink, when the quantity of ink consumption reaches about ½ of the ink capacity. The detection may alternatively be carried out at the timing close to ink end or at the timing having a less quantity of ink consumption or a greater remaining quantity of ink. The structure of the embodiment uses the piezoelectric element 153, sets the starting pulse, the terminating pulse, or the number of measured pulses corresponding to the detection time as the externally specified detection condition. The detection condition may be a detection timing (defined, for example, by the time of detection, by the interval of detection, or on power supply) or a frequency of detection. The data corresponding to the specified detection condition sent from the ink cartridge to the control device of the printer may be part of the detection condition or a code allocated in advance to the detection condition. The data corresponding to the detection condition may not be sent from the ink cartridge to the control device, when not required.

In the structure of the embodiment, detection of the presence or the absence of ink is performed by the hardware logic. The detection may alternatively be carried out by the software configuration. In one example of this modified structure, the count on the counter 176 is not transmitted to the control device 222, and the detection memory module determines the presence or the absence of ink and transmits the result of the determination regarding the presence or the absence of ink to the control device 222.

The scope and spirit of the present invention are indicated by the appended claims, rather than by the foregoing description.

The invention claimed is:

1. A cartridge having a chamber to hold a recording material used for printing therein, said cartridge being mountable on a printing apparatus, said cartridge comprising:

a sensor that detects a state of the recording material held in the chamber, under an externally specified detection condition;

a detection module that detects the state of the recording material held in the chamber under the externally specified detection condition to obtain detection result, and outputs the detection result as a number of pulses; and an output module that outputs the state of the recording material detected under the externally specified detection condition in a form of a pulse count, together with data corresponding to the externally specified detection condition.

2. A cartridge in accordance with claim 1, wherein the recording material is an ink of a predetermined color.

3. A cartridge in accordance with claim 1, wherein the recording material is a toner for any one of a photocopier, a facsimile, and a laser printer.

4. A cartridge in accordance with claim 1, wherein said sensor detects a presence or an absence of the recording material in the chamber.

5. A cartridge in accordance with claim 1, wherein said sensor measures at least one of a temperature, a viscosity, a humidity, a particle size, a hue, a remaining quantity, and a pressure of the recording material.

6. A cartridge in accordance with claim 1, wherein said output module outputs the detection pulse count by radio communication.

7. A cartridge in accordance with claim 1, said cartridge further comprising:

a memory that stores a parameter corresponding to the state of the recording material held in the chamber.

8. A cartridge in accordance with claim 1, said cartridge further comprising:

a radio communication module that exchanges data with the printing apparatus by radio communication, wherein said cartridge receives the externally specified detection condition from the printing apparatus via said radio communication module.

9. A cartridge in accordance with claim 8, wherein said radio communication module has a loop antenna for the radio communication, and comprises a power supply module that utilizes an electromotive force induced in said antenna to supply electric power into said cartridge.

10. A printing apparatus comprising:

a cartridge mounted to the printing apparatus, said cartridge having a chamber to hold a recording material used for printing, said cartridge including;

a sensor that detects a state of the recording material held in the chamber; under an externally specified detection condition;

a detection module that detects the state of the recording material held in the chamber under the externally specified detection condition to obtain detection result, and outputs the detection result as a number of pulses; and an output module that outputs the state of the recording material detected under the externally specified detection condition in the form of a pulse count, together with data corresponding to the externally specified detection condition;

a condition specification module that specifies the externally specified detection condition;

an input module that receives the detection result output from said output module of said cartridge; and a verification module that verifies the detection result.

11. A printing apparatus in accordance with claim 10, wherein said output module of said cartridge outputs data corresponding to the externally specified detection condition, together with the detection result, said input module of said printing apparatus receives the output data, together with the detection result output from said output module of said cartridge, and said verification module of said printing apparatus compares the input data with the externally specified detection condition specified by said condition specification module, verifies validity of the detection result if there is correspondence between the input data and the externally specified detection condition, and carries out a preset series of processing relating to the state of the recording material.

12. A printing apparatus in accordance with claim 11, wherein said verification module comprises a notification element that, if there is not correspondence between the input data and the detection condition specified by said condition specification module, indicates there is not such correspondence.

* * * * *